US009435493B2

(12) United States Patent
Pickard

(10) Patent No.: US 9,435,493 B2
(45) Date of Patent: Sep. 6, 2016

(54) HYBRID REFLECTOR SYSTEM FOR LIGHTING DEVICE

(75) Inventor: Paul Kenneth Pickard, Morrisville, NC (US)

(73) Assignee: CREE, INC., Durham, NC (US)

( * ) Notice: Subject to any disclaimer, the term of this patent is extended or adjusted under 35 U.S.C. 154(b) by 271 days.

(21) Appl. No.: 12/606,377

(22) Filed: Oct. 27, 2009

(65) Prior Publication Data

US 2011/0096548 A1 Apr. 28, 2011

(51) Int. Cl.

| | |
|---|---|
| ***F21K 99/00*** | (2016.01) |
| ***F21V 7/00*** | (2006.01) |
| ***F21V 29/505*** | (2015.01) |

(Continued)

(52) U.S. Cl.

CPC ..... *F21K 9/137* (2013.01); *F21K 9/1375* (2013.01); *F21V 7/0025* (2013.01); *F21V 29/505* (2015.01); *F21V 29/507* (2015.01); *F21V 29/74* (2015.01); *F21V 7/04* (2013.01); *F21V 17/164* (2013.01); *F21V 29/004* (2013.01); *F21V 29/89* (2015.01); *F21Y 2101/02* (2013.01); *F21Y 2113/007* (2013.01)

(58) Field of Classification Search

CPC ..... F21Y 2101/02; F21Y 2103/003; F21Y 2113/00; F21V 7/0025; F21V 7/06; F21V 7/09; F21V 13/04; F21V 14/04; F21V 7/04; F21K 9/00

USPC ..... 362/268, 281, 296.01, 297, 299–305, 362/307–310, 311.02, 329, 335–341, 362/346–348, 351, 355, 375, 507, 509, 517, 362/522; 359/857, 358

See application file for complete search history.

(56) References Cited

U.S. PATENT DOCUMENTS 1,393,573 A * 10/1921 Ritter ..... 362/509
1,880,399 A * 10/1932 Benjamin ..... 362/277

(Continued)

FOREIGN PATENT DOCUMENTS

CN 1841183 A 10/2006
CN 1957481 5/2007

(Continued)

OTHER PUBLICATIONS

International Search Report and Written Opinion for counterpart PCT Application No. PCT/US2010/002827 mailed May 2, 2011.

(Continued)

*Primary Examiner* — Hargobind S Sawhney

(74) *Attorney, Agent, or Firm* — Koppel, Patrick, Heybl & Philpott

(57) ABSTRACT

A hybrid reflector system for use in lighting application. The system is particularly well-suited for use with solid state light sources, such as light emitting diodes (LEDs). Embodiments of the system include a bowl-shaped outer reflector and an intermediate reflector disposed inside the bowl and proximate to the light source. The reflectors are arranged to interact with the light emitted from the source to produce a beam having desired characteristics. Some of the light passes through the system without interacting with any of the reflector surfaces. This uncontrolled light, which is already emitting in a useful direction, does not experience optical loss normally associated with one or more reflective bounces. Some of the light emanating from the source at higher angles that would not be emitted within the desired beam angle is reflected by one or both of the reflectors, redirecting that light to achieve a tighter beam.

60 Claims, 9 Drawing Sheets

(51) Int. Cl.

| | |
|---|---|
| ***F21V 29/507*** | (2015.01) |
| ***F21V 29/74*** | (2015.01) |
| *F21V 7/04* | (2006.01) |
| *F21V 17/16* | (2006.01) |
| *F21V 29/00* | (2015.01) |
| *F21Y 101/02* | (2006.01) |
| *F21Y 113/00* | (2016.01) |
| *F21V 29/89* | (2015.01) |

(56) References Cited

U.S. PATENT DOCUMENTS 2,214,600 A * 9/1940 Winkler ..... 362/279
2,981,827 A * 4/1961 Orsatti et al. ..... 362/84
2,981,927 A 4/1961 Orsatti et al.
3,395,272 A * 7/1968 Nicholl ..... 362/305
4,120,026 A 10/1978 Tsuchihashi et al.
4,420,800 A * 12/1983 Van Horn ..... 362/297
4,710,699 A 12/1987 Miyamoto
5,018,157 A 5/1991 Deppe et al. ..... 372/45.013
5,477,436 A 12/1995 Bertling et al.
5,768,339 A * 6/1998 O'Hara ..... 378/147
5,851,063 A 12/1998 Doughty et al.
5,912,915 A 6/1999 Reed et al. ..... 372/93
5,962,971 A 10/1999 Chen
5,998,925 A 12/1999 Shimizu et al.
6,055,261 A 4/2000 Reed et al.
6,066,861 A 5/2000 Hohn et al.
6,069,440 A 5/2000 Shimizu et al.
6,076,948 A 6/2000 Bukosky et al. ..... 362/494
6,084,250 A 7/2000 Justel et al.
6,111,276 A 8/2000 Mauk ..... 257/98
6,132,072 A 10/2000 Turnbull et al.
6,149,283 A 11/2000 Conway et al.
6,153,971 A 11/2000 Shimizu
6,163,038 A 12/2000 Chen et al.
6,212,213 B1 4/2001 Weber et al.
6,234,648 B1 5/2001 Borner et al.
6,245,259 B1 6/2001 Hohn et al.
6,252,254 B1 6/2001 Soules et al.
6,255,670 B1 7/2001 Srivastava et al.
6,294,800 B1 9/2001 Duggal et al.
6,319,425 B1 11/2001 Tasaki et al.
6,337,536 B1 1/2002 Matsubara et al.
6,373,188 B1 4/2002 Johnson et al.
6,396,081 B1 5/2002 Tews et al.
6,409,361 B1 6/2002 Ikeda ..... 362/240
6,429,583 B1 8/2002 Levinson et al.
6,441,558 B1 8/2002 Muthu et al.
6,454,439 B1 * 9/2002 Camarota ..... 362/293
6,459,713 B2 10/2002 Jewell ..... 372/46
6,469,322 B1 10/2002 Srivastava et al.
6,480,299 B1 11/2002 Drakopoulos et al.
6,501,100 B1 12/2002 Srivastava et al.
6,501,102 B2 12/2002 Mueller-Mach et al.
6,504,179 B1 1/2003 Ellens et al.
6,504,301 B1 1/2003 Lowery
6,509,651 B1 1/2003 Matsubara et al.
6,513,949 B1 2/2003 Marshall et al.
6,538,371 B1 3/2003 Duggal et al.
6,547,249 B2 4/2003 Collins, III et al.
6,550,949 B1 4/2003 Bauer et al.
6,552,495 B1 4/2003 Chang
6,558,032 B2 * 5/2003 Kondo et al. ..... 362/516
6,576,930 B2 6/2003 Reeh et al.
6,577,073 B2 6/2003 Shimizu et al.
6,585,397 B1 7/2003 Ebiko
6,600,175 B1 7/2003 Baretz et al.
6,600,324 B2 7/2003 St. Germain
6,603,151 B2 8/2003 Lin et al. ..... 257/98
6,608,332 B2 8/2003 Shimizu et al.
6,614,179 B1 9/2003 Shimizu et al.
6,616,862 B2 9/2003 Srivastava et al.
6,624,638 B2 9/2003 St. Germain
6,635,503 B2 10/2003 Andrews et al.
6,636,003 B2 10/2003 Rahm et al.
6,642,666 B1 11/2003 St. Germain
6,657,236 B1 12/2003 Thibeault et al. ..... 257/98
6,685,852 B2 2/2004 Setlur et al.
6,692,136 B2 2/2004 Marshall et al.
6,703,173 B2 3/2004 Lu et al.
6,720,583 B2 4/2004 Nunoue et al. ..... 257/98
6,737,801 B2 5/2004 Ragle
6,744,194 B2 6/2004 Fukasawa et al.
6,758,582 B1 7/2004 Hsiao et al.
6,762,563 B2 7/2004 St. Germain et al.
6,784,462 B2 8/2004 Schubert
6,784,463 B2 8/2004 Camras et al.
6,793,373 B2 * 9/2004 Matsuba et al. ..... 362/260
6,797,987 B2 9/2004 Chen ..... 257/98
6,812,502 B1 11/2004 Chien et al. ..... 257/99
6,817,735 B2 11/2004 Shimizu et al.
6,817,737 B2 * 11/2004 Romano et al. ..... 362/293
6,840,652 B1 1/2005 Hymer
6,841,804 B1 1/2005 Chen et al.
6,853,010 B2 2/2005 Slater, Jr. et al.
6,882,101 B2 4/2005 Ragle
6,885,035 B2 4/2005 Bhat et al.
6,914,267 B2 7/2005 Fukasawa et al.
6,936,857 B2 8/2005 Doxsee et al.
6,957,899 B2 10/2005 Jiang et al.
6,967,116 B2 11/2005 Negley
6,986,594 B2 * 1/2006 Wirth et al. ..... 362/328
6,995,402 B2 2/2006 Ludowise et al. ..... 257/91
7,005,679 B2 2/2006 Tarsa et al.
7,008,078 B2 3/2006 Shimizu et al.
7,009,199 B2 3/2006 Hall
7,009,343 B2 3/2006 Lim et al.
7,014,336 B1 3/2006 Ducharme et al.
7,023,019 B2 4/2006 Maeda et al.
7,055,991 B2 6/2006 Lin ..... 362/311.02
7,095,056 B2 8/2006 Vitta et al.
7,121,690 B1 10/2006 Ramer et al.
7,125,143 B2 10/2006 Hacker
7,135,664 B2 11/2006 Vornsand et al.
7,141,442 B2 11/2006 Sano
7,213,940 B1 5/2007 Van De Ven et al. ..... 362/231
7,213,942 B2 5/2007 Jiang et al.
7,217,583 B2 5/2007 Negley et al.
7,221,044 B2 5/2007 Fan et al. ..... 257/676
7,250,715 B2 7/2007 Mueller et al.
7,256,557 B2 8/2007 Lim et al.
7,262,439 B2 8/2007 Radkov
7,275,841 B2 10/2007 Kelly ..... 362/345
7,278,760 B2 10/2007 Heuser et al.
7,321,126 B2 * 1/2008 Singer et al. ..... 250/492.2
7,332,365 B2 2/2008 Nakamura et al.
7,339,965 B2 3/2008 Ledentsov et al. ..... 372/45
7,358,954 B2 4/2008 Negley et al.
7,365,485 B2 4/2008 Fukasawa et al.
7,387,405 B2 6/2008 Dutcharme et al.
7,417,259 B2 8/2008 Sakai et al.
7,422,504 B2 9/2008 Maeda et al.
7,453,195 B2 11/2008 Radkov
7,473,934 B2 1/2009 Nagai et al.
7,573,074 B2 8/2009 Shum et al. ..... 257/99
7,622,746 B1 11/2009 Lester et al. ..... 257/98
7,638,610 B2 12/2009 Lee et al. ..... 257/98
7,722,220 B2 5/2010 Van De Ven ..... 362/294
7,784,977 B2 * 8/2010 Moolman et al. ..... 362/298
7,922,366 B2 4/2011 Li ..... 362/304
8,118,451 B2 * 2/2012 Householder et al. ..... 362/277
8,212,273 B2 7/2012 McKenzie et al.
8,235,541 B2 8/2012 Chen ..... 362/97
8,324,652 B1 12/2012 Lester et al.
8,431,423 B2 4/2013 Basin et al. ..... 438/26
8,492,785 B2 7/2013 Hodota ..... 257/98
8,686,429 B2 4/2014 Bergmann et al.
8,791,471 B2 7/2014 Leung ..... 257/88
2003/0025212 A1 2/2003 Bhat et al.
2003/0030063 A1 2/2003 Sosniak et al.
2003/0042908 A1 3/2003 St. Germain
2003/0089918 A1 5/2003 Hiller et al.
2003/0128733 A1 7/2003 Tan et al. ..... 372/96

(56) References Cited

U.S. PATENT DOCUMENTS

2003/0210550 A1 11/2003 Matsuba et al.
2004/0046178 A1 3/2004 Sano
2004/0085463 A1 5/2004 Sharma ..... 348/231.99
2004/0105264 A1 6/2004 Spero
2004/0155565 A1 8/2004 Holder et al. ..... 313/113
2004/0217362 A1 11/2004 Slater et al.
2004/0264193 A1 12/2004 Okumura
2005/0030744 A1 2/2005 Ducharme et al.
2005/0063061 A1 3/2005 Grawert et al.
2005/0168994 A1* 8/2005 Jacobson et al. ..... 362/311
2005/0211993 A1 9/2005 Sano et al. ..... 257/79
2005/0225222 A1 10/2005 Mazzochette et al. ..... 313/46
2005/0242358 A1 11/2005 Tu et al.
2006/0012989 A1 1/2006 Lee
2006/0022582 A1 2/2006 Radkov
2006/0039009 A1 2/2006 Kiesel et al. ..... 356/519
2006/0049411 A1 3/2006 Nakamura et al.
2006/0060874 A1 3/2006 Edmond et al. ..... 257/98
2006/0076568 A1 4/2006 Keller et al. ..... 257/98
2006/0105482 A1 5/2006 Alferink et al.
2006/0113548 A1 6/2006 Chen et al.
2006/0138435 A1 6/2006 Tarsa et al.
2006/0157723 A1 7/2006 Lampkin et al. ..... 257/98
2006/0163586 A1 7/2006 Denbaars et al.
2006/0163589 A1 7/2006 Fan et al. ..... 257/88
2006/0181192 A1 8/2006 Radkov et al.
2006/0245184 A1 11/2006 Galli
2006/0274805 A1 12/2006 Song et al.
2006/0278885 A1 12/2006 Tain et al.
2007/0001188 A1 1/2007 Lee
2007/0051966 A1 3/2007 Higashi et al.
2007/0057270 A1 3/2007 Bour et al. ..... 257/99
2007/0090381 A1 4/2007 Otsuka et al.
2007/0139920 A1 6/2007 Van De Ven et al.
2007/0139923 A1 6/2007 Negley et al.
2007/0145380 A1 6/2007 Shum et al.
2007/0170447 A1 7/2007 Negley et al.
2007/0171145 A1 7/2007 Coleman et al.
2007/0202623 A1 8/2007 Gao et al.
2007/0217193 A1 9/2007 Lin
2007/0217200 A1 9/2007 Yang et al. ..... 362/277
2007/0223219 A1 9/2007 Medendorp, Jr. et al.
2007/0236911 A1 10/2007 Negley
2007/0263393 A1 11/2007 Van De Ven
2007/0267983 A1 11/2007 Van De Ven et al.
2007/0274063 A1 11/2007 Negley
2007/0274080 A1 11/2007 Negley et al.
2007/0276606 A1 11/2007 Radkov et al.
2007/0278503 A1 12/2007 Van De Ven et al.
2007/0278934 A1 12/2007 Van De Ven et al.
2007/0279440 A1 12/2007 Negley
2007/0279903 A1 12/2007 Negley et al.
2007/0280624 A1 12/2007 Negley et al.
2008/0035949 A1 2/2008 Fudeta et al. ..... 257/99
2008/0061304 A1 3/2008 Huang et al.
2008/0084685 A1 4/2008 Van De Ven et al.
2008/0084700 A1 4/2008 Van De Ven
2008/0084701 A1 4/2008 Van De Ven et al.
2008/0088248 A1 4/2008 Myers
2008/0089053 A1 4/2008 Negley
2008/0106895 A1 5/2008 Van De Ven et al.
2008/0106907 A1 5/2008 Trott et al.
2008/0112168 A1 5/2008 Pickard
2008/0112170 A1 5/2008 Trott et al.
2008/0112183 A1 5/2008 Negley
2008/0123341 A1 5/2008 Chiu et al.
2008/0130265 A1 6/2008 Negley et al.
2008/0130285 A1 6/2008 Negley et al.
2008/0130298 A1 6/2008 Negley et al.
2008/0136313 A1 6/2008 Van De Ven et al.
2008/0137347 A1 6/2008 Trott et al.
2008/0144688 A1 6/2008 Chua et al.
2008/0179602 A1 7/2008 Negley et al.
2008/0185609 A1 8/2008 Kozawa et al.
2008/0191233 A1 8/2008 Yang et al.
2008/0211416 A1 9/2008 Negley et al.
2008/0259589 A1 10/2008 Van De Ven
2008/0265268 A1 10/2008 Braune et al. ..... 257/98
2008/0272391 A1 11/2008 Kapur et al.
2008/0278928 A1 11/2008 Van De Ven et al.
2008/0278940 A1 11/2008 Van De Ven et al.
2008/0278950 A1 11/2008 Pickard et al.
2008/0278952 A1 11/2008 Trott et al.
2008/0304260 A1 12/2008 Van De Ven et al.
2008/0304261 A1 12/2008 Van De Ven et al.
2008/0304269 A1 12/2008 Pickard et al.
2008/0309255 A1 12/2008 Myers et al.
2008/0310154 A1 12/2008 Van De Ven et al.
2008/0310158 A1 12/2008 Harbers et al.
2009/0026478 A1 1/2009 Yoon et al. ..... 257/98
2009/0029495 A1 1/2009 Li et al. ..... 438/29
2009/0050907 A1 2/2009 Yuan et al.
2009/0108269 A1 4/2009 Negley et al.
2009/0160363 A1 6/2009 Negley et al.
2009/0161356 A1 6/2009 Negley et al.
2009/0184616 A1 7/2009 Van De Ven et al.
2009/0184666 A1 7/2009 Myers et al.
2009/0213591 A1 8/2009 Katabe et al. ..... 362/236
2009/0231856 A1 9/2009 Householder
2009/0246895 A1 10/2009 You et al.
2009/0283787 A1 11/2009 Donofrio et al. ..... 257/98
2010/0001299 A1 1/2010 Chang et al. ..... 257/89
2010/0012962 A1 1/2010 Hong et al.
2010/0029023 A1 2/2010 Neff et al. ..... 438/15
2010/0033655 A1 2/2010 Nakamoto ..... 349/81
2010/0038659 A1 2/2010 Chen et al.
2010/0039822 A1* 2/2010 Bailey ..... 362/296.1
2010/0051995 A1 3/2010 Katsuno et al.
2010/0059785 A1 3/2010 Lin et al.
2010/0065881 A1 3/2010 Kim
2010/0103678 A1* 4/2010 Van De Ven et al. ..... 362/294
2010/0117099 A1 5/2010 Leung ..... 257/88
2010/0117111 A1 5/2010 Illek et al. ..... 257/98
2010/0140635 A1 6/2010 Ibbetson et al.
2010/0155746 A1 6/2010 Ibbetson et al.
2010/0158437 A1 6/2010 Decorby ..... 385/14
2010/0163887 A1 7/2010 Kim ..... 257/76
2010/0163900 A1 7/2010 Seo ..... 257/98
2010/0165633 A1* 7/2010 Moolman et al. ..... 362/298
2010/0171094 A1 7/2010 Lu et al. ..... 257/13
2010/0171135 A1 7/2010 Engl et al.
2010/0279437 A1 11/2010 Neff et al. ..... 438/14
2010/0308354 A1 12/2010 David et al. ..... 257/98
2010/0327295 A1 12/2010 Peng et al. ..... 257/88
2011/0001148 A1 1/2011 Sun et al. ..... 257/88
2011/0001422 A1 1/2011 Aanegola et al. ..... 313/501
2011/0025190 A1 2/2011 Jagt ..... 313/499
2011/0044027 A1 2/2011 Chen ..... 362/97
2011/0075423 A1* 3/2011 Van De Ven ..... 362/249.02
2011/0084294 A1 4/2011 Yao ..... 257/93
2011/0182073 A1 7/2011 Sanpei et al. ..... 362/294
2012/0025244 A1 2/2012 Suh ..... 257/98
2012/0086026 A1 4/2012 Engl et al.
2012/0280263 A1 11/2012 Ibbetson et al.
2014/0167065 A1 6/2014 Bergmann et al.
2014/0312373 A1 10/2014 Donofrio

FOREIGN PATENT DOCUMENTS

CN 101103467 1/2008
CN 201007449 1/2008
CN 101449100 6/2009
CN 101460779 6/2009
DE 39 16 875 12/1990
DE 42 28 895 3/1994
DE 103 35 077 3/2005
DE 102004040277 2/2006
DE 102007003282 7/2008
DE 102008005497 7/2009
DE 102008035900 11/2009
EP 0 838 866 A2 4/1998
EP 0 971 421 A2 1/2000
EP 1 024 399 A1 8/2000
EP 1 160 883 A2 12/2001

(56) References Cited

FOREIGN PATENT DOCUMENTS

| | | | |
|---|---|---|---|
| EP | 1 193 772 | A2 | 4/2002 |
| EP | 1 367 655 | A1 | 12/2003 |
| EP | 1 462 711 | A1 | 12/2004 |
| EP | 1 566 848 | A2 | 8/2005 |
| EP | 1 571 715 | A1 | 9/2005 |
| EP | 1750310 | A2 | 2/2007 |
| EP | 1 760 795 | A2 | 3/2007 |
| EP | 1 850 383 | A1 | 10/2007 |
| EP | 2259345 | A1 | 12/2010 |
| EP | 2369650 | A2 | 9/2011 |
| JP | 06045649 | | 2/1994 |
| JP | 06268252 | | 9/1994 |
| JP | 10-163535 | | 6/1998 |
| JP | 2000-183408 | | 6/2000 |
| JP | 2000-294834 | | 10/2000 |
| JP | 2001 156331 | | 6/2001 |
| JP | 2001/307506 | | 11/2001 |
| JP | 2002-150821 | | 5/2002 |
| JP | 2003-515956 | | 5/2003 |
| JP | 2003-529889 | | 10/2003 |
| JP | 2004-080046 | | 3/2004 |
| JP | 2004-103443 | | 4/2004 |
| JP | 2004-253309 | | 9/2004 |
| JP | 2004-356116 | | 12/2004 |
| JP | 2004-363055 | | 12/2004 |
| JP | 2005-142311 | | 6/2005 |
| JP | 2005197289 | | 7/2005 |
| JP | 2007-122950 | | 5/2007 |
| JP | 2007-141737 | | 6/2007 |
| TW | 595689 | | 5/2003 |
| TW | 595689 | | 6/2004 |
| TW | M281297 | | 11/2005 |
| TW | 200805717 | | 1/2008 |
| TW | 200834991 | | 8/2008 |
| WO | WO 00/19546 | | 4/2000 |
| WO | WO 2000/034709 | A1 | 6/2000 |
| WO | WO 01/41215 | | 6/2001 |
| WO | WO 02/054503 | | 7/2002 |
| WO | WO 2005/004202 | A2 | 1/2005 |
| WO | WO 2005/013365 | A2 | 2/2005 |
| WO | WO 2005/022030 | | 3/2005 |
| WO | WO 2005/066539 | A1 | 7/2005 |
| WO | WO 200507838 | | 8/2005 |
| WO | WO 2005078338 | A1 | 8/2005 |
| WO | WO 2005/124877 | | 12/2005 |
| WO | WO 2005117152 | | 12/2005 |
| WO | WO 2006/003559 | | 1/2006 |
| WO | WO 2006/028312 | A1 | 3/2006 |
| WO | WO 2006/061728 | A2 | 6/2006 |
| WO | WO 2006/092697 | A1 | 9/2006 |
| WO | WO 2007121739 | | 1/2007 |
| WO | WO 2007115040 | | 10/2007 |
| WO | WO 2007/130536 | A2 | 11/2007 |
| WO | WO 2008089324 | A2 | 7/2008 |
| WO | WO 2008089324 | A3 | 7/2008 |
| WO | WO 2008107654 | | 9/2008 |
| WO | WO2008149250 | | 12/2008 |
| WO | WO 2009/056927 | A1 | 5/2009 |
| WO | WO 2010/029475 | A1 | 3/2010 |
| WO | WO 2010029475 | | 3/2010 |
| WO | WO2010151600 | | 12/2010 |
| WO | WO2011031098 | A2 | 3/2011 |
| WO | WO2011071100 | A1 | 6/2011 |

OTHER PUBLICATIONS

U.S. Appl. No. 60/792,859, filed Apr. 18, 2006, Van De Ven.
U.S. Appl. No. 60/793,524, filed Apr. 20. 2006, Van De Ven.
U.S. Appl. No. 60/868,134, filed Dec. 1, 2006, Van De Ven.
U.S. Appl. No. 60/978,880, filed Oct. 10, 2007, Van De Ven.
U.S. Appl. No. 60/990,435, filed Nov. 27, 2007, Van De Ven.
U.S. Appl. No. 60/990,439, filed Nov. 27, 2007, Negley.
U.S. Appl. No. 60/990,724, filed Nov. 28, 2007, Negley.
U.S. Appl. No. 61/022,886, filed Jan. 23, 2008, Myers.
U.S. Appl. No. 60/037,365, filed Mar. 18, 2008, Van De Ven.
U.S. Appl. No. 61/039,926, filed Mar. 27, 2008, Myers.
U.S. Appl. No. 61/041,404, filed Apr. 1, 2008, Negley.
U.S. Appl. No. 61/075,513, filed Jun. 25, 2008, Roberts.
"Cree XLamp XR-E and XR-C LED Binning and Labeling", pp. 1-15, Copyright 2007-2008 Cree, Inc. Application Note: CLD-AP12.008.
Cree® XLamp® 7090 XR-E Series LED Binning and Labeling.
International Search Report and Written Opinion corresponding to International Application No. PCT/US2007/009462; Mailing Date: Oct. 24, 2008.
International Search Report and Written Opinion corresponding to International Application No. PCT/US2007/009459; Mailing Date: Mar. 3, 2008.
International Search Report and Written Opinion corresponding to International Application No. PCT/US2008/054665; Mailing Date: Jul. 16, 2008.
International Search Report and Written Opinion corresponding to International Application No. PCT/US2007/086593; Mailing Date: Apr. 18, 2008.
International Search Report and Written Opinion corresponding to International Application No. PCT/US2006/048654; Mailing Date: Feb. 13, 2008.
International Search Report and Written Opinion corresponding to International Application No. PCT/US2008/063042; Mailing Date: Jul. 21, 2008.
International Search Report and Written Opinion corresponding to International Application No. PCT/US2007/086027; Mailing Date: Apr. 25, 2008.
International Search Report and Written Opinion corresponding to International Application No. PCT/US2008/063021; Mailing Date: Aug. 5, 2008.
International Search Report and Written Opinion corresponding to International Application No. PCT/US2008/051633; Mailing Date: Aug. 14, 2008.
International Search Report and Written Opinion corresponding to International Application No. PCT/US2008/063016; Mailing Date: Aug. 5, 2008.
International Search Report and Written Opinion corresponding to International Application No. PCT/US2008/063027; Mailing Date: Jul. 23, 2008.
International Search Report and Written Opinion corresponding to International Application No. PCT/US2007/09629; Mailing Date: Feb. 11, 2008.
International Search Report and Written Opinion corresponding to International Application No. PCT/US2008/079299; Mailing Date: Jan. 9, 2009.
International Search Report and Written Opinion corresponding to International Application No. PCT/US2008/063020; Mailing Date: Jul. 21, 2008.
International Search Report and Written Opinion corresponding to International Application No. PCT/US2009/003768; Mailing Date: Sep. 24, 2009.
Krames, "Lumileds Lighting, Light from Silicon Valley" Progress and Future Direction of LED Technology, SSL Workshop, Nov. 13, 2003, pp. 1-21.
"LED Binning" Cree LED Light, pp. 1-12 (2007).
Mirhosseini, et al. "Improved Color Rendering and Luminous Efficacy in Phosphor-Converted White Light-Emitting Diodes by Use of Dual-Blue Emitting Active Regions" Optical Society of America 17(13):10806-10813 (2009).
Ohno, "Simulation Analysis of White LED Spectra and Color Rendering" National Institute of Standards and Technology, USA, pp. 1-4.
"Specifications for the Chromaticity of Solid State Lighting Products" American National Standard Lighting Group, ANSI_NEMA_ANSLG C78.377-2008, pp. 1-17 (Jan. 9, 2008).
Van de Ven et al., "Warm White Illumination with High CRI and High Efficacy by Combining 455 nm Excited Yellowish Phosphor LEDs and Red AlInGaP LEDs", First International Conference on White LEDs and Solid State Lighting.
Cree's LR6, LR24 and LR4 data sheets, downloaded on Jul. 23, 2010, available at www.cree.com.

(56) References Cited

OTHER PUBLICATIONS

Cree's XLamp® MP-L EasyWhite™ LED, downloaded on Jun. 1, 2010 at http://www.cree.com/products/xlamp_mpl.asp pp. 1-2.
U.S. Appl. No. 11/947,323, filed Nov. 29, 2007.
Rosco, Inc. PERMACOLOR Data Sheet, Copyright 2001, #1013 Goldenrod.
Rosco, Inc. PERMACOLOR Data Sheet, Copyright 2001, #3409 ¼ CTO.
Related U.S. Appl. No. 12/154,691, filed Mary 23, 2008.
Related U.S. Appl. No. 12/156,995, filed Jun. 5, 2008.
Related U.S. Appl. No. 12/475,261, filed May 29, 2009.
International Preliminary Report on Patentability from Application No. PCT/US09/66938, dated Apr. 3, 2012.
"High-Performance GaN-Based Vertical-Injection Light-Emitting Diodes With TiO2-SiO2 Omnidirectional Reflector and n-GaN Roughness" by H. W. Huang, et al., IEEE Photonics Technology Letters, vol. 19, No. 8, Apr. 15, 2007. pp. 565-567.
Office Action from U.S. Appl. No. 12/418,796, Dated: Jul. 20, 2011.
Office Action from U.S. Appl. No. 12/329,722, Dated: Oct. 27, 2010.
Dom LED Downlighting. Lithonia Lighting: an Acuity Brands, Company, www.lithonia.com, © 2009.
Ecos. Lighting the Next Generation. gothan: a division of Acuity Brands Lighting Inc., © 2008.
Renaissance Lighting brochure, © 2010.
International Search Report and Written Opinion for PCT Application No. PCT/US2011/001394 mailed Nov. 3, 2011.
International Search Report and Written Opinion for Application No. PCT/US2012/034564, dated Sep. 5, 2012.
International Search Report and Written Opinion from PCT Application No. PCT/US2013/028684, dated May 28, 2013.
Jong Kyu kim, et al., "GaInN Light-emitting Diodes with RuO2/SiO2/Ag Omni-directional Reflector", Applied Physics Letters, AIP, American Institute of Physics, Nelville, NY, US, vol. 84. No. 22, May 31, 2004, pp. 4508-4510, XP012061652.
Y.S. Zhao, et al., "Efficiency Enhancement of InGaN/GaN Light-Emitting Diodes with a Back-Surface distributed Bragg Reflector", Journal of Electronic Materials, vol. 32. No. 12, Dec. 1, 2003, pp. 1523-1526, XP055063308.
Xu Qing-tao, et al., "Enhancing Extraction Efficiency from GaN-based LED by Using an Omni-directional Reflector and Photonic Crystal", Optoelectronics Letters, vol. 5, No. 6, Nov. 1, 2009, pp. 405-408, XP055063309.
J.-Q Xi, et al., "Optical Thin-film Materials with Low Refractive Index for Broadband Elimination of Fresnel Reflection", Nature Photonics, Nature Publishing Group, UK, vol. 1, No. 3, Mar. 1, 2007, pp. 176-179, XP002590687.
Decision of Patent Grant from Japanese Patent Appl. No. 2011-539526, dated Oct. 22, 2013.
Notice of Reasons for Rejection from Japanese Patent Appl. No. 2011-539526, dated Jun. 25, 2013.
First Office Action and Search Report from Chinese Patent Appl. No. 201080023107.8, dated Jul. 12, 2013.
Office Action from U.S. Appl. No. 12/855,500, dated May 31, 2013.
Response to OA from U.S. Appl. No. 12/855,500, filed Sep. 3, 2013.
Office Action from U.S. Appl. No. 13/071,349, dated May 28, 2013.
Response to OA from U.S. Appl. No. 18/071,349, filed Jul. 18, 2013.
Office Action from U.S. Appl. No. 13/071,349, dated Jan. 17, 2013.
Response to OA from U.S. Appl. No. 13/071,349, filed Apr. 10, 2013.
Office Action from U.S. Appl. No. 12/553,025, dated Jun. 19, 2013.
Huang at al. High-Performance GaN-Based Vertical-Injection Light-Emitting Diodes with TiO2-Sio2 Ohnidirectional Reflector and n-GaN Roughness. IEEE Photonics Technology Letters, vol. 19, No. 8, Apr. 15, 2007, pp. 565-567.
Raoufi et al. Surface characterization and microstructure of ITO thin films at different annealing temperatures. Applied Surface Science 253 (2007), pp. 9085-9090.
Office Action from U.S. Appl. No. 13/168,689, dated Jun. 28, 2013.
Office Action from U.S. Appl. No. 12/418,796, dated Aug. 7, 2012.
Response to OA from U.S. Appl. No. 12/418,796, filed Nov. 7, 2012.
Office Action from U.S. Appl. No. 12/418,796, dated Feb. 22, 2012.
Response to OA from U.S. Appl. No. 12/418,796, filed Jun. 22, 2012.
Office Action from U.S. Appl. No. 13/415,626, dated Sep. 28, 2012.
Response to OA from U.S. Appl. No. 13/415,626, filed Jan. 23, 2013.
Office Action from U.S. Appl. No. 12/855,500, dated Oct. 1, 2012.
Response to OA from U.S. Appl. No. 12/855,500, filed Feb. 25, 2013.
Office Action from U.S. Appl. No. 12/757,179, dated Dec. 31, 2012.
Response to OA from U.S. Appl. No. 12/757,179, filed Apr. 23, 2013.
Office Action from U.S. Appl. No. 13/415,626, dated Feb. 28, 2013.
Response to OA from U.S. Appl. No. 13/415,626, filed Apr. 17, 2013.
First Office Action from Chinese Patent Appl. No. 201180047069.4, dated Dec. 18, 2013.
Office Action from Patent Application No. 12/855,500, dated Dec. 4, 2013.
First Office Action from Japanese Patent Appl. No. 201180047069. 4. dated: Dec. 18, 2013.
Search Report from Japanese Patent Appl. No. 201180047069.4, dated Dec. 18, 2013.
Comments on the Written Opinion and Amendment of the Application from European Patent Appl. No. 12723543.0, dated Feb. 21, 2014.
Final Office Action from U.S. Appl. No. 12/553,025, dated Dec. 31, 2013.
Lin, et al., "Enhancement of InGaN-GaN Indium—Tin—Oxide Flip-Chip Light-Emitting Diodes with TiO2-SiO2 Multilayer Stack Omnidirectional Reflector", IEEE Photonics Technology Letters, vol. 18, No. 19, Oct. 1, 2006.
First Office Action from Chinese Patent Application No. 2009-801492034, dated Jun. 24, 2014.
European Examination Report from European Patent Appl. No. 10 725 524.2-1757, dated Nov. 3, 2014.
Search Report from Taiwanese Appl. No. 099121883, dated Oct. 2, 2014.
Huang, et al., "High-Performance GaN-Based Vertical-Injection Light-Emitting Diodes With TiO2-SiO2 Omnidriectional Reflector and n-GaN Roughness", IEEE Photonics Technology Letters, vol. 19, No. 8, Apr. 15, 2007.
International Search Report and Written Opinion from PCT/US2014/058896, dated Dec. 22, 2014.
Office Action from U.S. Appl. No. 13/028,946, dated Oct. 28, 2014.
Response to OA from U.S. Appl. No. 13/028,946, filed Dec. 15, 2014.
Office Action from U.S. Appl. No. 14/219,916, dated Oct. 29, 2014.
Office Action from U.S. Appl. No. 13/909,927, dated Nov. 6, 2014.
First Office Action and Search Report from Chinese Patent Appl. No. 2009-801492053, dated Jun. 20, 2014.
Office Action from U.S. Appl. No. 12/757,179. dated Jul. 15, 2014.
Office Action from U.S. Appl. No. 13/909,927, dated Aug. 8, 2014.
Examination Report from European Patent Appl. No. 10774320.5-1757, dated Sep. 5, 2014.
Second Office Action from Chinese Patent Appl. No. 2011800470694, dated Aug. 6, 2014.
International Preliminary Report on Patentability from Appl. No. PCT/US2013/026684, dated Sep. 18, 2014.
Third Office Action from Chinese Appl. No. 201080023107.8, dated Sep. 29, 2014.
Communication from European Appl. No. 13709035.3-1551, dated Oct. 15, 2014.
Office Action from U.S. Appl. No. 13/370,696, dated Aug. 27, 2014.
Examination Report from European Appl. No. 10 725 524.2-1757, dated Jun. 19. 2015.
Third Office Action from Chinese Appl. No. 2011800470694, dated Apr. 29, 2015.
Third Office Action from Chinese Appl. No. 200980149203 4, dated Jul. 3, 2015.

(56) References Cited

OTHER PUBLICATIONS

Notice of Allowance from Taiwanese Patent Appl. No. 099110005, dated Jul. 20, 2015.
Office Action from U.S. Appl. No. 14/219,916, dated Jun. 17, 2015.
Margalit et al. "64o C Continuous-Wave Operation of 1.5-um Vertical Cavity Laser", 1997, IEEE Journal od Selected Topics in Quantum Electronics, vol. 3, pp. 359-365.
Office Action from U.S. Appl. No. 14/185,589, dated Jul. 28, 2015.
Office Action from U.S. Appl. No. 14/050,001, dated Jul. 30, 2015.
Second Office Action from Chinese Patent Appl. No. 2009801492034, dated Jan. 6, 2015.
Examiner's Report from European Patent Appl. No. 10 774 320.5-1757, dated Feb. 10, 2015.
Office Action and Search Report from Taiwanese Patent Appl. No. 10420278720, dated Mar. 9, 2015.
Office Action from U.S. Appl. No. 12/553,025, dated Jan. 13, 2015.
Sanchez et al. Ion and electron beam assisted growth of nanometric SimOn structures for near field microscopy, Review of Scientific Instruments, vol. 73, #11, 2002. pp. 3901-3907.
Office Action from U.S. Appl. No. 14/185,589. dated Feb. 19, 2015.
Office Action from U.S. Appl. No. 19/219,916, dated Mar. 6, 2015.
Su, et al., "Nitride-Based LED's with n- GaN Current Spreading Layers", 2005. IEEE Electron Devices Letters, vol. 26, No. 12, pp. 891-893; Dec. 2005.
Second OA from Chinese Patent Appl. No. 201080023107.8, dated Mar. 7, 2014.
Office Action from U.S. Appl. No. 12/757,179. dated Mar. 11, 2014.
Office Action from U.S. Appl. No. 13/909,927, dated Apr. 2, 2014.
Office Action from Chinese Patent Appl. No. 200980149205.3, dated Mar. 11, 2015.
Rejection Decision Chinese Patent Appl. No. 2010800231078, dated Mar. 19, 2015.
Office Action from Taiwanese Patent Appl. No. 099110005. dated Mar. 26, 2015.
Office Action from Taiwanese Patent Appl No. 099110005, dated Mar. 23, 2015.
Office Action from U.S. Appl. No. 13/909,927, dated Apr. 23, 2015.
Office Action from U.S. Appl. No. 12/553,025, dated May 29, 2015.
Office Action and Search Report from Taiwanese Patent Appl. No. 10421191660, dated Sep. 2, 2015.
Notice of Issuance from Chinese Patent Application No. 200980149205.3, dated Sep. 24, 2015.
Certificate of Invention from Chinese Patent appl. No. 200960149205.3, dated Dec. 16, 2015.
Notice of Allowance from Chinese Patent Appl. No. 200980149203.4, dated Dec. 4, 2015.
Notification of Reexamination from Chinese Patent appl. No. 201080023107.8. dated Dec. 2, 2015.
Office Action from Chinese Patent appl. No. 201180047069.4, dated Dec. 24, 2015.
Examination Report from European Patent Appl. No. 10 774 320.5, dated Jan. 6, 2016.
First Office Action from Chinese Patent Appl. No. 2012800412299, dated Dec. 16, 2015.
Comments on the Written Opinion and Amendment from European Patent Appl. No. 14733825.3, dated Jan. 14, 2016.
Examination from European Patent Appl. No. 10 725 524.2-1757, dated Feb. 3, 2016.
Office Action from Patent Application No. 14/050,001, filed Jan. 29, 2016.
Office Action from Taiwanese Patent Appl. No. 099136758, dated Oct. 26, 2015.
Examination from European Patent Appl. No. 09836676.8, dated Oct. 26. 2015.
Office Action Summary from Korean Patent Appl. No. 10-2011-7015872, dated Nov. 6, 2015.
Office Action from U.S. Appl. No. 12/553,025, dated Nov. 10, 2015.
Office Action from U.S. Appl. No. 14/699,302; Apr. 5, 2016.
Office Action for Korean Application No. 10-2011-7015872; Dated May 26, 2016.
Notice of Allowance for Application No. 099121883; Dated Jun. 2, 2016.
Office Action from U.S. Appl. No. 14/050,001; Jun. 23, 2016.

* cited by examiner

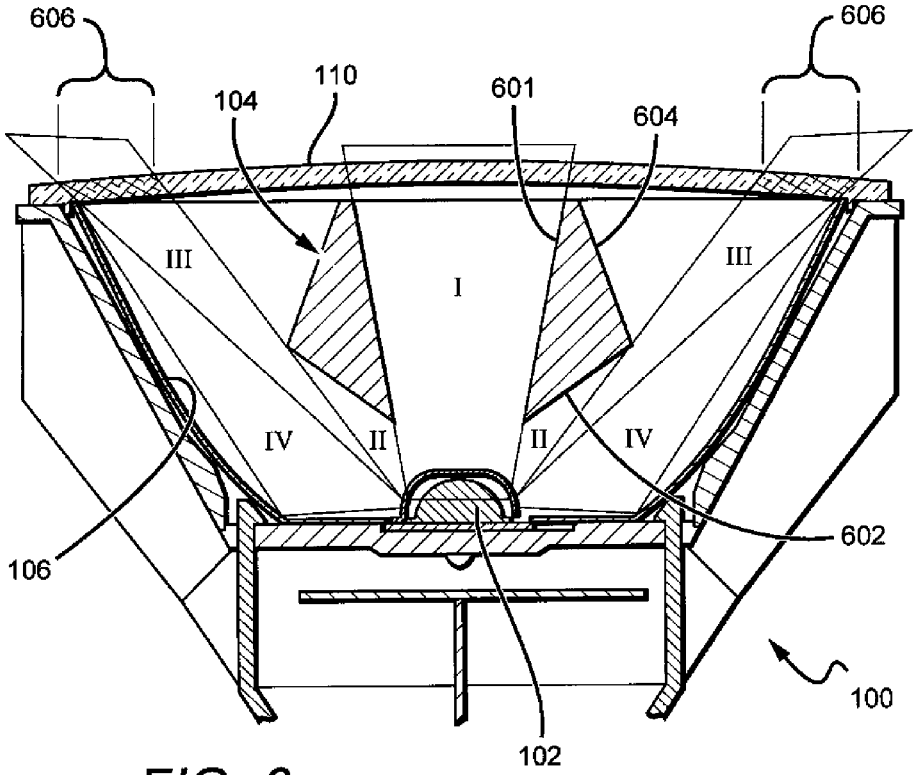
FIG. 6
FIG. 7
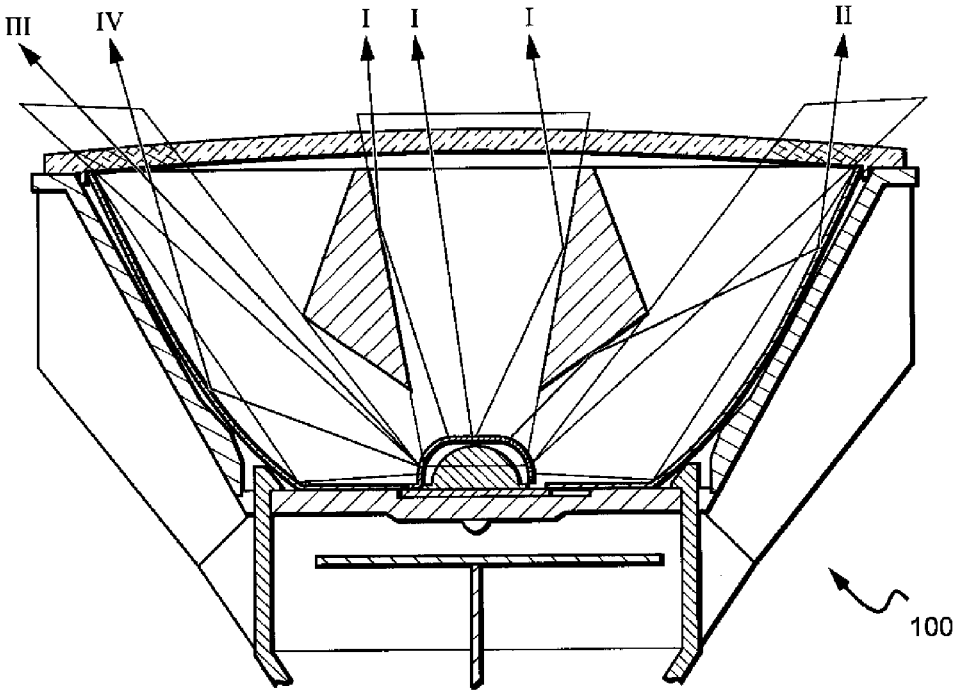

FIG. 14
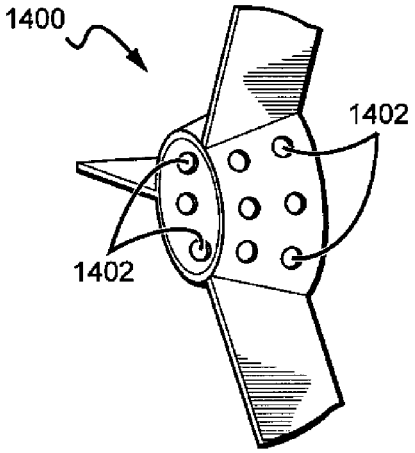
FIG. 15
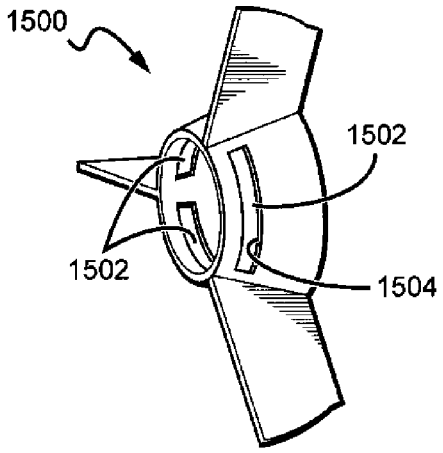
FIG. 16
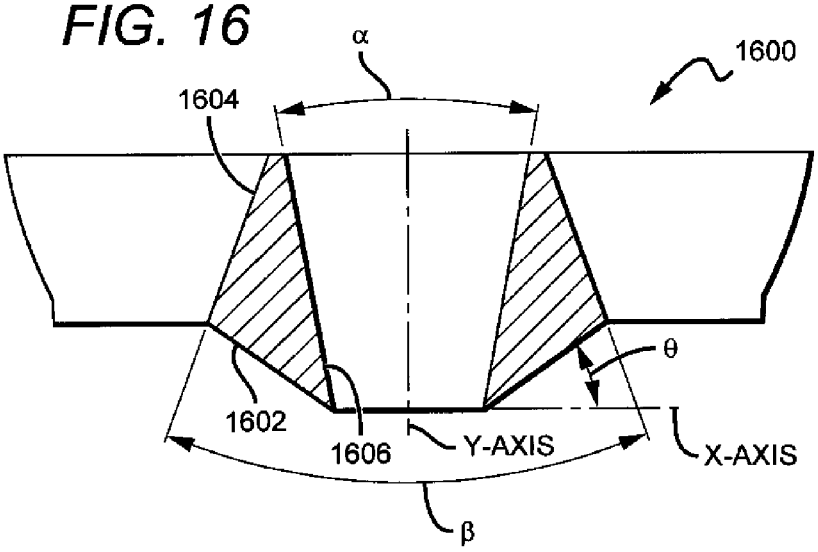
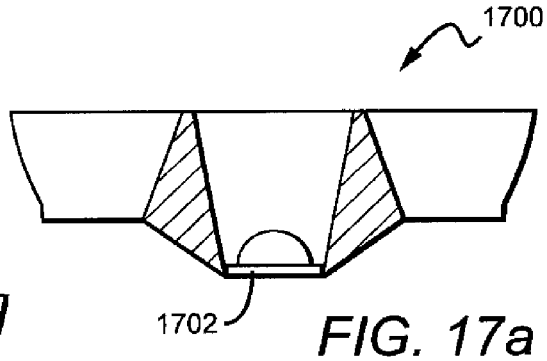
FIG. 17a
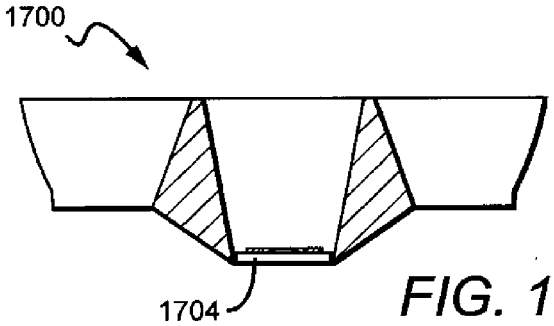
FIG. 17b

HYBRID REFLECTOR SYSTEM FOR LIGHTING DEVICE

BACKGROUND OF THE INVENTION

1. Field of the Invention

The invention relates generally to reflector systems for lighting applications and, more particularly, to reflector systems for solid state light sources.

2. Description of the Related Art

Light emitting diodes (LEDs) are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Typical direct view lamps, which are known in the art, emit both uncontrolled and controlled light. Uncontrolled light is light that is directly emitted from the lamp without any reflective bounces to guide it. According to probability, a portion of the uncontrolled light is emitted in a direction that is useful for a given application. Controlled light is directed in a certain direction with reflective or refractive surfaces. The mixture of uncontrolled and controlled light define the output beam profile.

Also known in the art, a retroreflective lamp arrangement, such as a vehicle headlamp, utilizes multiple reflective surfaces to control all of the emitted light. That is, light from the source either bounces off an outer reflector (single bounce) or it bounces off a retroreflector and then off of an outer reflector (double bounce). Either way the light is redirected before emission and, thus, controlled. In a typical headlamp application, the source is an omni-emitter, suspended at the focal point of an outer reflector. A retroreflector is used to reflect the light from the front hemisphere of the source back through the envelope of the source, changing the source to a single hemisphere emitter.

Many modern lighting applications demand high power LEDs for increased brightness. High power LEDs can draw large currents, generating significant amounts of heat that must be managed. Many systems utilize heat sinks which must be in good thermal contact with the heat-generating light sources. Some applications rely on cooling techniques such as heat pipes which can be complicated and expensive.

SUMMARY OF THE INVENTION

A reflector system according to an embodiment of the present invention comprises the following elements. An outer reflector has a bowl shape with a base end and an open end. An intermediate reflector is disposed inside the outer reflector. The intermediate reflector is shaped to define an axial hole.

A lamp device according to an embodiment of the present invention comprises the following elements. A light source is mounted at a base end of an outer reflector. The light source is arranged to emit light toward an open end of the outer reflector. An intermediate reflector is disposed proximate to the light source, the intermediate reflector shaped to define a hole for at least some light from the light source to pass through. A housing is arranged to surround the outer reflector without obstructing the open end. A lens is arranged to cover the open end.

A lamp device according to an embodiment of the present invention comprises the following elements. An outer reflector comprises a plurality of panels, each of the panels having a cross-section defined by a compound parabola. The panels are arranged around a longitudinal axis to define a cavity and an open end. An intermediate reflector is disposed in the cavity and along the longitudinal axis.

BRIEF DESCRIPTION OF THE DRAWINGS

FIG. 6 is a cross-sectional view of a lamp device with an overlay of light emission regions within the device according to an embodiment of the present invention.

FIG. 7 is a cross-sectional view of a lamp device with an overlay of light emission regions within the device according to an embodiment of the present invention.

FIG. 14 shows a perspective view of an intermediate reflector according to an embodiment of the present invention.

FIG. 15 shows a perspective view of an intermediate reflector according to an embodiment of the present invention.

FIG. 16 is a cross-sectional view of an intermediate reflector according to an embodiment of the present invention.

FIGS. 17*a* and 17*b* are cross-sectional views of an intermediate reflector according to an embodiment of the present invention.

DETAILED DESCRIPTION OF THE INVENTION

Figure 1:
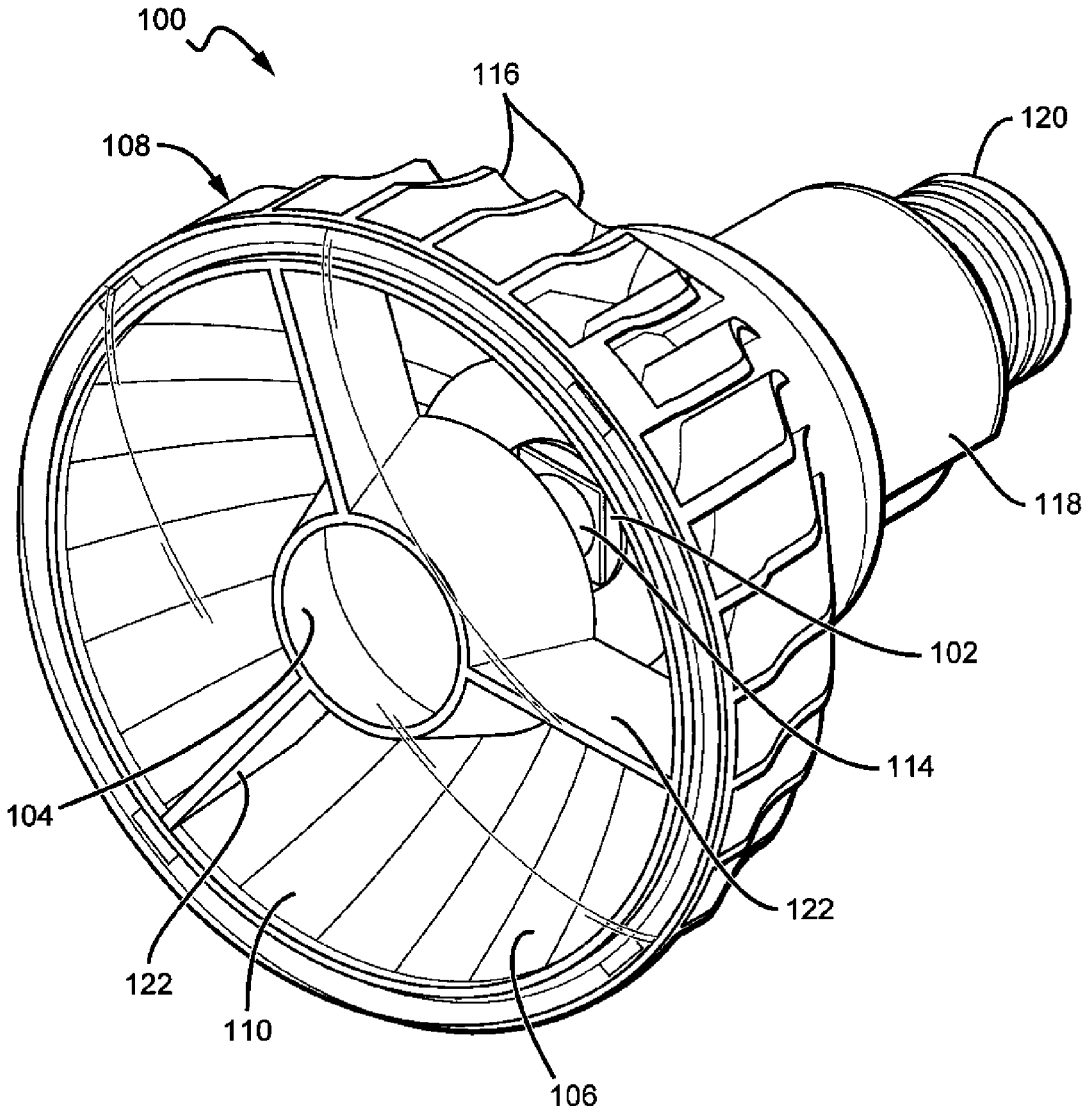
FIG. 1 is a perspective view of a lamp device according to an embodiment of the present invention.

Embodiments of the present invention provide an improved hybrid reflector system for use in lighting applications. The hybrid reflector system is particularly well-suited for use with solid state light sources, such as light emitting diodes (LEDs). Embodiments of the system include a bowl-shaped outer reflector and an intermediate reflector disposed inside the bowl and proximate to the light source. The reflectors are arranged to interact with the light emitted from the source to produce a beam having desired characteristics. The reflector arrangement allows some of the light to pass through the system without interacting with any of the reflector surfaces. This uncontrolled light, which is already emitting in a useful direction, does not experience the optical loss that is normally associated with one or more reflective bounces. Some of the light emanating from the source at higher angles that would not be emitted within the desired beam angle is reflected by one or both of the reflectors, redirecting that light to achieve a tighter beam.

It is understood that when an element is referred to as being "on" another element, it can be directly on the other element or intervening elements may also be present. Furthermore, relative terms such as "inner," "outer," "upper," "bottom," "above," "lower," "beneath," and "below," and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter. For example, the term may be used to describe a single blue LED, or it may be used to describe a red LED and a green LED in proximity. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

FIGS. 1-5 show various views of a lamp device 100 according to an embodiment of the present invention.

FIG. 1 is a perspective view of the lamp device 100. A light source 102 is disposed at the base of a bowl-shaped region within the lamp 100. Many applications, for example white light applications, necessitate a multicolor source to generate a blend of light that appears as a certain color to the human eye. In some embodiments multiple LEDs or LED chips of different colors or wavelength are employed, each in a different location with respect to the optical system. Because these wavelengths are generated in different locations and therefore follow different paths through the optical system, it is necessary to mix the light sufficiently so that color patterns are not noticeable in the output, giving the appearance of a homogenous source. Furthermore, even in embodiments wherein homogenous wavelength emitters are employed, it is advantageous to mix light from different locations in order to avoid projecting an image of the optical source onto the target.

An intermediate reflector 104 is disposed proximate to the light source 102. Some of the light emitted from the source 102 interacts with the intermediate reflector 104 such that it is redirected toward an outer reflector 106. The outer reflector 106 and the intermediate reflector 104 work in concert to shape the light into a beam having characteristics that are desirable for a given application. A protective housing 108 surrounds the light source 102 and the reflectors 104, 106. The source 102 is in good thermal contact with the housing 108 at the base of the outer reflector 106 to provide a pathway for heat to escape into the ambient. A lens 110 covers the open end of the housing 108 and provides protection from outside elements.

The light source 102 may comprise one or more emitters producing the same color of light or different colors of light. In one embodiment, a multicolor source is used to produce white light. Several colored light combinations will yield white light. For example, it is known in the art to combine light from a blue LED with wavelength-converted yellow light to create a white output. Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light. Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al. which is commonly assigned with the present application to CREE LED LIGHTING SOLUTIONS, INC. and fully incorporated by reference herein.

Color combinations can be achieved with a singular device having multiple chips or with multiple discreet devices arranged in proximity to each other. For example, the source 102 may comprise a multicolor monolithic structure (chip-on-board) bonded to a printed circuit board (PCB).

Figure 2:
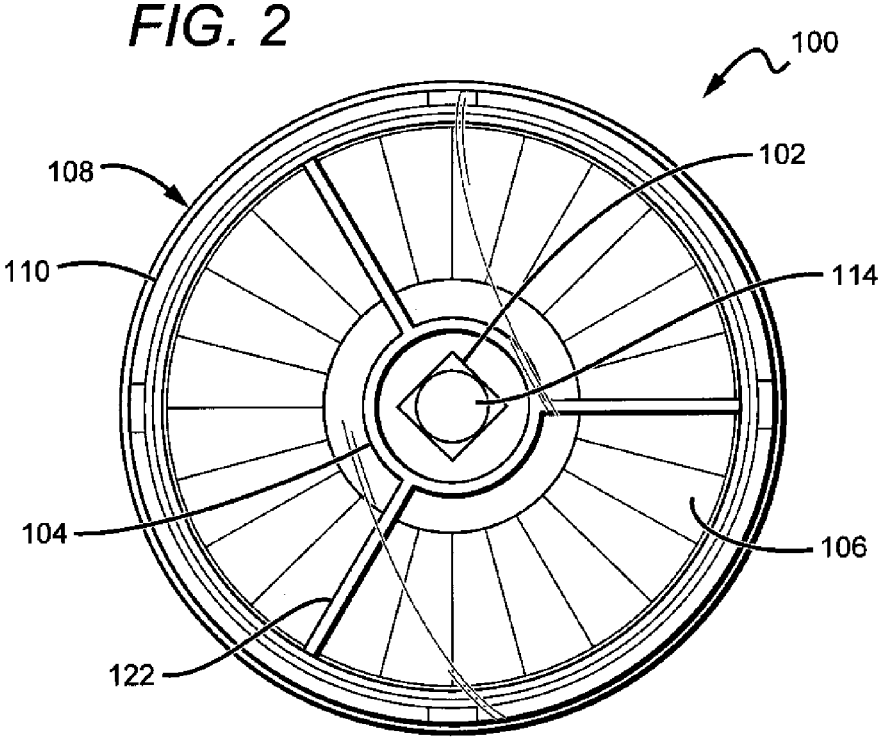
FIG. 2 is a bottom view of a lamp device according to an embodiment of the present invention.

FIG. 2 shows a bottom view of the lamp device 100, looking through the intermediate reflector 104 at the source 102. In some embodiments, several LEDs are mounted to a submount to create a single compact optical source. Examples of such structures can be found in U.S. patent application Ser. Nos. 12/154,691 and 12/156,995, both of which are assigned to CREE, INC., and both of which are fully incorporated by reference herein. In the embodiment shown in FIG. 1, the source 102 is protected by an encapsulant 114. Encapsulants are known in the art and, therefore, only briefly discussed herein. The encapsulant 114 material may contain wavelength conversion materials, such as phosphors for example.

The encapsulant 114 may also contain light scattering particles, voids or other optically active structures to help with the color mixing process in the near field. Although light scattering particles, voids or other optically active structures dispersed within or on the encapsulant 114 may cause optical losses, it may be desirable in some applications to use them in concert with the reflectors 104, 106 so long as the optical efficiency is acceptable.

In those embodiments in which the light source 102 is one or more LEDs, there may be more than one point of emission that needs to be considered. It is, therefore, beneficial to integrate a diffusive element into the lamp device.

Color mixing in the near field may be aided by providing a scattering/diffuser material or structure in close proximity to the light sources. A near field diffuser is in, on, or in close proximity to the light sources with the diffuser arranged so that the source can have a low profile while still mixing the light in the near field. By diffusing in the near field, the light may be pre-mixed to a degree prior to interacting with either of the reflectors 104, 106. Techniques and structures for near field mixing are discussed in detail in U.S. patent application Ser. No. 12/475,261 by Negley, et al. and assigned to CREE, INC. This application is incorporated by reference as if fully set forth herein.

A diffuser can comprise many different materials arranged in many different ways. In some embodiments, a diffuser film can be provided on the encapsulant 114. In other embodiments, the diffuser can be included within the encapsulant 114. In still other embodiments, the diffuser can be remote from the encapsulant, such as on the lens 110 as discussed in detail hereafter. The lens 110 may be textured across an entire surface, or it may have a certain portion that is textured such as an annular region, for example, depending on the application. Various diffusers can be used in combination. For example, both the encapsulant 114 and the lens 110 may comprise diffusive elements.

In embodiments comprising a diffuser film disposed on the lens 110, it is possible to adjust the profile of the output beam by adjusting the properties of the diffuser film. One property that may be adjusted is the output beam angle which can be narrowed or widened by using a weaker or stronger diffuser film, respectively.

For example, a lamp device designed to produce an output beam having a 50 degree beam angle can be adjusted to provide a beam having a 60 degree beam angle simply by including a stronger diffuser film on the lens. Thus, in some embodiments the output beam can be tailored by tweaking or replacing an inexpensive and easily accessible diffuser film without having to change the arrangement or structure of the intermediate and outer reflectors 104, 106.

Many different structures and materials can be used as a diffuser such as scattering particles, geometric scattering structures or microstructures, diffuser films comprising microstructures, or diffuser films comprising index photonic films. The diffuser can take many different shapes; it can be flat, hemispheric, conic, or variations of those shapes, for example.

The encapsulant 114 may also function as a lens to shape the beam prior to incidence on the reflectors 104, 106. The encapsulant may be hemispherical, parabolic, or another shape, depending on the particular optical effect that is desired.

Figure 3:
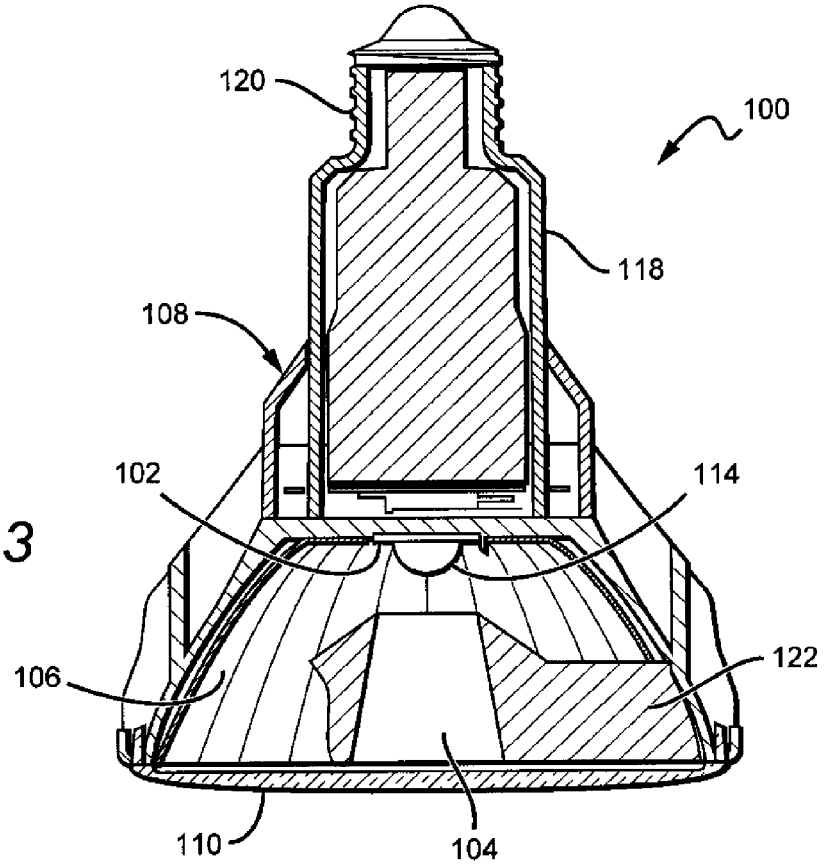
FIG. 3 is a side cut-away view of a lamp device according to an embodiment of the present invention.
Figure 4:
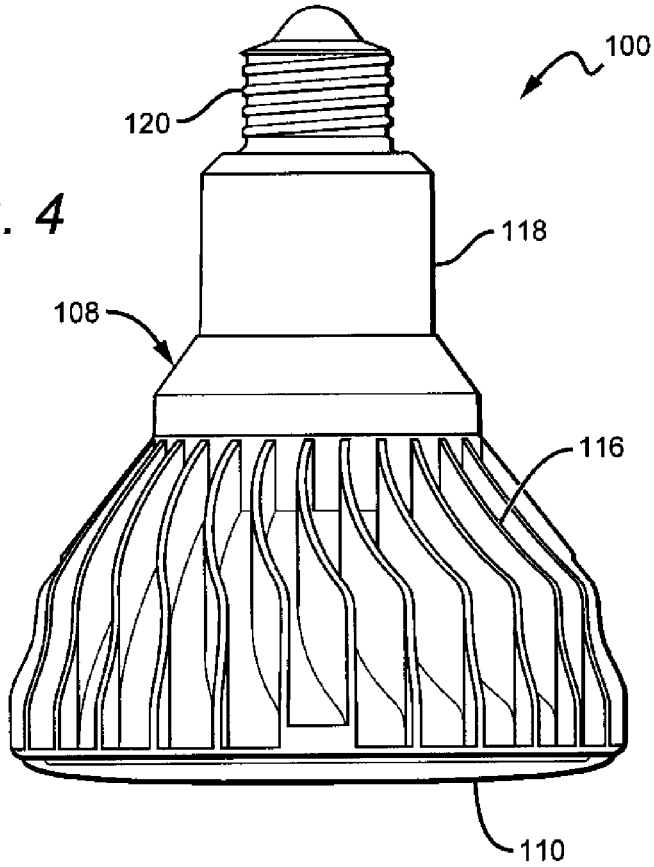
FIG. 4 is a side view of a lamp device according to an embodiment of the present invention.

FIG. 3 is a side cut-away view of the lamp device 100, showing the internal environment of the device 100. The housing 108 surrounds the outer reflector 106, protecting the internal components of the lamp device 100. The external portion of the housing 108 is best shown in FIG. 4, which is a side view of the lamp device 100. The lens 110 and the housing 108 may form a watertight seal to keep moisture from entering into the internal areas of the device 100. In some embodiments, an edge of the lens 110 remains exposed beyond the open end of the outer reflector 106 as discussed in further detail with reference to FIG. 13. In other embodiments, the lens may be recessed in the housing and connected to an inside surface thereof.

A portion of the housing 108 may comprise a material that is a good thermal conductor, such as aluminum or copper. The thermally conductive portion of the housing 108 can function as a heat sink by providing a path for heat from the source 102 through the housing 108 into the ambient. The source 102 is disposed at the base of the secondary reflector 106 such that the housing 108 can form good thermal contact with the source 102. To facilitate the transfer of heat, the housing 108 may include fin-shaped structures 116 which increase the surface area of the housing 108. Thus, the source 102 may comprise high power LEDs that generate large amounts of heat.

Power is delivered to the source 102 through a protective conduit 118. The lamp device 100 may be powered by a remote source connected with wires running through the conduit 118, or it may be powered internally with a battery that is housed within the conduit 118. The conduit 118 may have a threaded end 120 for mounting to an external structure. In one embodiment, an Edison screw shell may be attached to the threaded end 120 to enable the lamp 100 to be used in a standard Edison socket. Other embodiments can include custom connectors such as a GU24 style connector, for example, to bring AC power into the lamp 100. The device 100 may also be mounted to an external structure in other ways. The conduit 118 functions not only as a structural element, but may also provide electrical isolation for the high voltage circuitry that it houses which helps to prevent shock during installation, adjustment and replacement. The conduit 118 may comprise an insulative and flame retardant thermoplastic or ceramic, although other materials may be used.

In this particular embodiment, the intermediate reflector 104 is suspended between the source 102 and the open end of the outer reflector 106 by three supportive legs 122 extending from the intermediate reflector 104 through the outer reflector 106 to the housing. In other embodiments, more or fewer legs can be used to support the intermediate reflector 104. The outer reflector 106 may comprise slits 123 to allow the legs 122 of the intermediate reflector 104 to connect with the housing 108. In other embodiments, the intermediate reflector 104 may snap-fit directly into the lens 110, eliminating the need for structures connected to the outer reflector 106 altogether.

Figure 5:
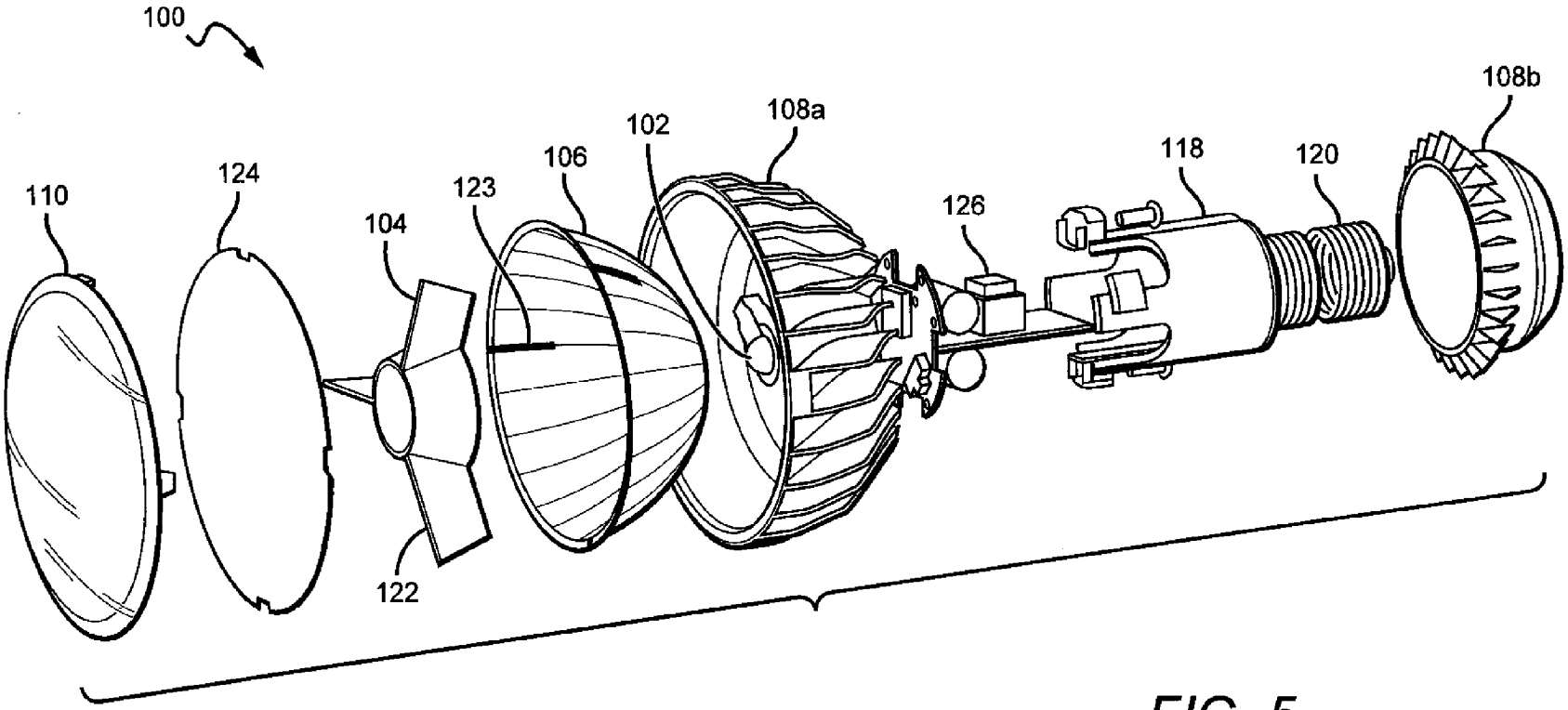
FIG. 5 is an exploded view of a lamp device according to an embodiment of the present invention.

FIG. 5 is an exploded view of the lamp device 100. In this embodiment, a diffuser film 124 is disposed on the internal side of the lens 110 as shown. The diffuser film 124 may be uniformly diffusive across its entire face, or it may be patterned to have a non-uniform diffusive effect. For example, in some embodiments, the diffuser may be more diffusive in an annular region around the perimeter of the film 124 to provide additional scattering of the light which is incident on the outer perimeter portion of the lens 110.

As mentioned herein, the source 102 may be powered with an external source or an internal source. Internal power components 126 are protected by the housing 108 as shown. The power components 126 may comprise voltage and current regulation circuitry and/or other electronic components. Batteries may also be disposed within the housing for those embodiments having an internal power source or to act as a backup in case an external power source fails. The housing 108 may comprise a single piece, or it can comprise multiple components 108*a*, 108*b* as shown in FIG. 5. Multiple components 108*a*, 108*b* can be separable for easy access to the internal power components 126.

The characteristics of the output light beam are primarily determined by the shape and arrangement of the intermediate reflector 104, the outer reflector 106, and the diffuser film 124, if present.

The outer reflector 106 has a bowl or dome shape. The reflective surface of the outer reflector 106 may be smooth or faceted (as shown FIG. 5). The lamp device 100 comprises a faceted outer reflector 106 with 24 adjacent panels. The faceted surface helps to further break up the image of the different colors from the source 102. This is one suitable construction for the 25 degree beam angle output of the device 100. Other constructions are possible. The outer reflector 106 may be specular or diffuse. Many acceptable materials may be used to construct the outer reflector 106. For example, a polymeric material which has been flashed with a metal may used. The outer reflector 106 can also be made from a metal, such as aluminum or silver.

The outer reflector 106 principally functions as a beam shaping device. Thus, the desired beam shape will influence the shape of the outer reflector 106. The outer reflector 106 is disposed such that it may be easily removed and replaced with other secondary reflectors to produce an output beam having particular characteristics. In the device 100, the outer reflector 106 has a compound parabolic cross section with a truncated end portion that allows for a flat surface on which to mount the source 102.

The compound parabolic shape of outer reflector 106 focuses light from the source 102 at two different points. Each parabolic section of the outer reflector has a different focus. For example, in lamp device 100, one of the parabolic sections of the reflector 106 provides a focus that is 5 degrees off axis, while the other parabolic section provides a focus that is 10 degrees off axis. Many different output profiles can be achieved by tweaking the shape of the outer reflector 106 or the sections that compose outer reflector 106.

The outer reflector 106 may be held inside the housing 108 using known mounting techniques, such as screws, flanges, or adhesives. In the embodiment of FIG. 5, the outer reflector 106 is held in place by the lens plate 110 which is affixed to the open end of the housing 108. The lens plate 110 may be removed, allowing easy access to the outer reflector 106 should it need to be removed for cleaning or replacement, for example. The lens plate 110 may be designed to further tailor the output beam. For example, a convex shape may be used to tighten the output beam angle. The lens plate 110 may have many different shapes to achieve a desired optical effect.

At least some of the light emitted from the source 102 interacts with the intermediate reflector 104. FIGS. 6 and 7 are cross-sectional views of lamp device 100 showing how light emitted within different ranges of angles interacts with the reflectors 104, 106. In this embodiment, the intermediate reflector 104 is shaped to define a frusto-conical hole aligned along a longitudinal axis running from the center of the base end to the center of said open end of said outer reflector 106. Although the internal surface 601 of the intermediate reflector 104 is linear in this embodiment, it is understood that the surface may be curved or curvilinear and may be segmented. The light emitted from source 102 is emitted into one of four regions as shown in FIGS. 6 and 7.

FIG. 6 illustrates four regions I, II, III and IV into which the light is initially emitted.

Light emitted in region I from the front of the source 102 passes freely through the axial hole in the intermediate reflector 104 out toward the open end of the outer reflector 106. Some of the light reflects off the reflective internal surface 601 of the intermediate reflector 104 before it escapes.

Because the intermediate reflector 104 is spaced from the light source 102, some of the light is initially emitted into region II. This light is incident on a first exterior surface 602 of the intermediate reflector 104 that faces the base end of the outer reflector 106 at an angle. The exterior surface 602 comprises a reflective material such that light that is incident on the surface 602 is reflected toward outer reflector 106 and ultimately redirected out of the device 100. Without the exterior surface 602, the region II light would escape the device 100 at an angle that is too large for the light to be within the target beam width. Thus, the exterior surface 602 and the outer reflector 106 provide a double-bounce path that allows the region II light to remain largely within the same angular distribution as the light emitted in region I.

Light that is emitted in region III passes to the lens 110 without impinging on either of the reflectors 104, 106.

Another portion of the light is initially emitted in region IV. This light is incident on the outer reflector 106 and redirected out of the device 100, most of which is emitted within the desired angular distribution of the region I light. A second exterior surface 604 of the intermediate reflector 104 faces the open end of the outer reflector 106 at an angle such that substantially all of the region IV light that reflects off the outer reflector 106 is not obscured by the intermediate reflector 104. Thus, it only incurs one reflective bounce.

The only light that is emitted outside the desired angular distribution is the light initially emitted in region III. To compensate, the lens 110 may comprise a textured region 606 around the outer perimeter. In some embodiments a diffusive film may be included on or adjacent to the lens 110 instead of or in combination with a textured lens as discussed herein. Diffusion near the perimeter of the lens provides more fill light outside the desired primary beam. Other texturing/diffusion patterns are possible either on the lens 110 or on a separate diffusive film 124 (shown in FIG. 5). Various diffuser film strengths may be used. For example, in the 25 degree beam angle embodiment a diffuser film having a 10 degree full width half maximum (FWHM) strength is suitable.

FIG. 7 shows an exemplary ray-trace for light initially emitted into each of the four regions. The three central rays from region I travel through the axial hole of the intermediate reflector 104. The ray marked II experiences two bounces, the first off the intermediate reflector 104, the second off the outer reflector 106. The ray associated with region III is emitted at a high angle without interacting with either of the reflectors 104, 106. However, this region III ray may encounter a diffusive structure (shown in FIG. 6) at or before the lens 110, redirecting the ray at another angle. The ray coming from region IV reflects once off the outer reflector 106 before it is emitted.

The intermediate reflector 104 and the outer reflector 106 can be modified to provide many different distributions according to a desired center beam candlepower (CBCP) and beam angle. The intermediate reflector 104 should be arranged to ensure that an acceptable portion of the light is emitted within the desired beam angle while minimizing the amount of light that is subject to double-bounce emission and the increased absorption that is associated therewith.

Although the first and second exterior surfaces 602, 604 have linear cross sections, it may be desirable to design them to have non-linear cross sections. For example, the first and second exterior surfaces 602, 604 of the intermediate reflector 104 may be parabolic or ellipsoidal, and the surface of the outer reflector 106 may be compound parabolic. Many other combinations are possible.

It is also possible to vary the output beam profile by adjusting the angles of the first and second exterior surfaces 602, 604.

It is understood that many different beam angles are possible with embodiments of the present invention. FIGS. 1-7 illustrate the lamp device 100 which is designed to produce a relatively narrow beam having a 25 degree beam angle.

Figure 8:
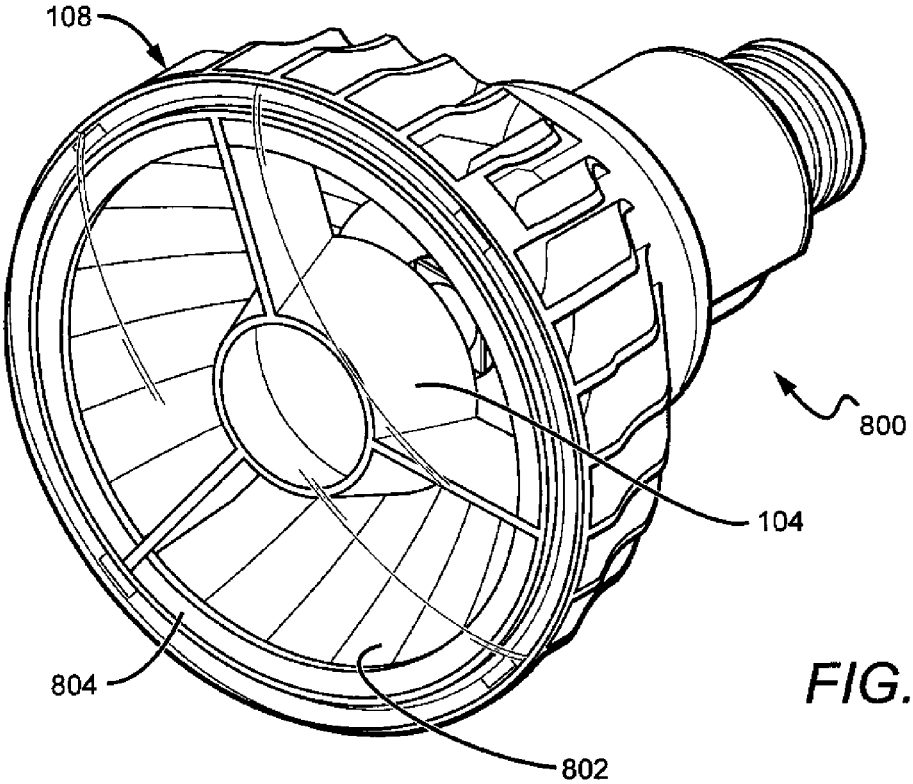
FIG. 8 is a perspective view of a lamp device according to an embodiment of the present invention.
Figure 9:
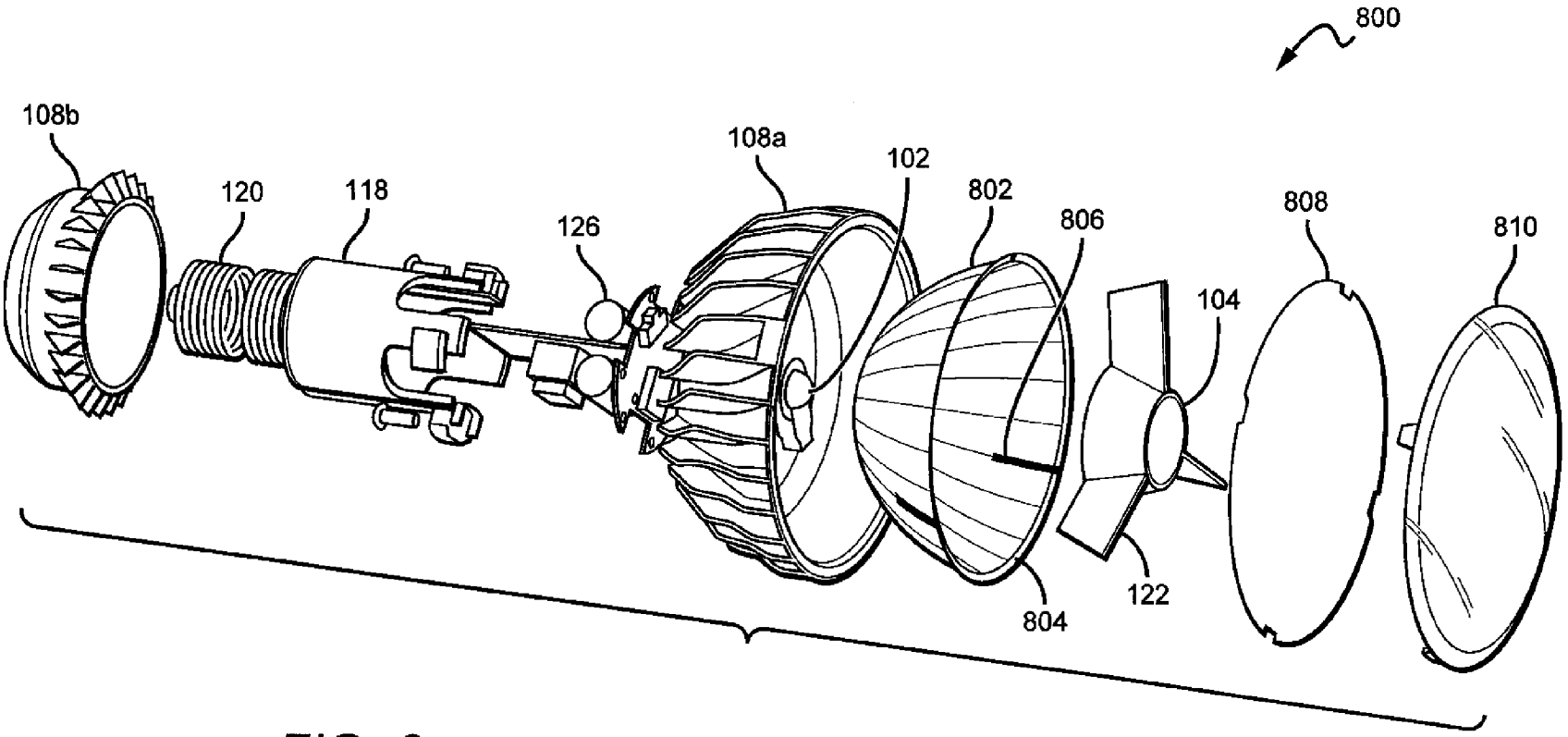
FIG. 9 is an exploded view of a lamp device according to an embodiment of the present invention.

FIGS. 8 and 9 show another embodiment of a lamp device 800 according to the present invention. The lamp device 800 contains many similar elements as the lamp device 100. Similar elements are indicated with the same reference numbers.

FIG. 8 is a perspective view of the lamp device 800 that is designed to produce an output beam having a 50 degree beam angle. The intermediate reflector 104 may be similarly shaped, as in this embodiment, or it may have a different shape. The outer reflector 802 is shaped differently than the outer reflector 106. The outer reflector 802 has a narrower opening at the open end of the housing 108. A flange 804 allows the outer reflector 802 to fit snugly within the housing. The shape of the outer reflector 802 is such that the light is emitted at a wider angle (i.e., 50 degrees). In this embodiment, the outer reflector 802 has a compound parabolic cross-section and comprises adjacent faceted panels similar to the device 100. The device 800 comprises 24 panels; however, because the surface area of the outer reflector 802 is smaller than that of the outer reflector 106, fewer panels may be required. However, this is not necessarily the case especially if the size of the individual panels is decreased.

FIG. 9 is an exploded view of the lamp device 800. Slits 806 allow the intermediate reflector 104 to be mounted to the housing 108 through the outer reflector 802. The flange 804 can either rest on or fit just inside the housing as shown. A stronger diffuser film 808 is used to produce the 50 degree beam angle in this embodiment. For example, a 20 degree FWHM diffuser strength is suitable, although other diffuser strengths may be used. Because the desired 50 degree beam angle is wider in lamp device 800, a stronger diffuser film can be used than can be used in embodiments designed to produce narrower beam angles, such as lamp device 100, for example.

As shown herein, different combinations of the various internal elements can produce an output beam having a wide range of characteristics. Thus, it is possible to achieve different light beams by switching out only a few components. For example, it may be possible to switch from a flood profile to a narrow flood profile or a spot profile by simply replacing the outer reflector and the diffuser film.

Figure 10:
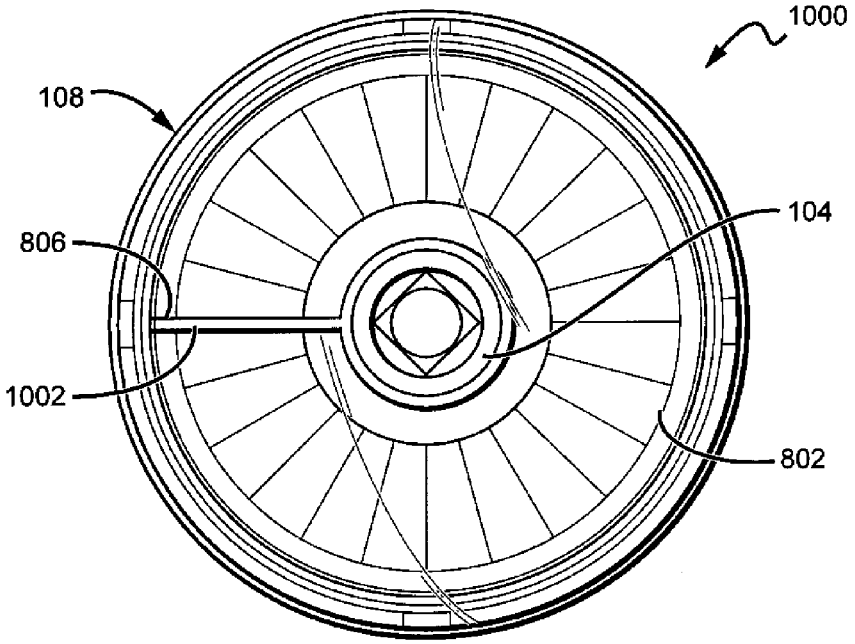
FIG. 10 is a bottom view of a lamp device according to an embodiment of the present invention.

FIG. 10 is a bottom view of a lamp device 1000 according to another embodiment of the present invention. The device is similar to lamp device 800 and is designed to produce a 50 degree beam angle output. However, lamp device 1000 comprises only a single leg 1002 to mount the intermediate reflector 104. The leg 1002 extends through the slit 806 in the outer reflector 802, allowing for connection to the housing 108. It may be desirable to use a single thin leg 1002 for mounting so as to minimize the amount of light that is obstructed and possibly absorbed by the mount mechanism. In other embodiments, a pole or a spoke may be used as the mount mechanism.

Figure 11:
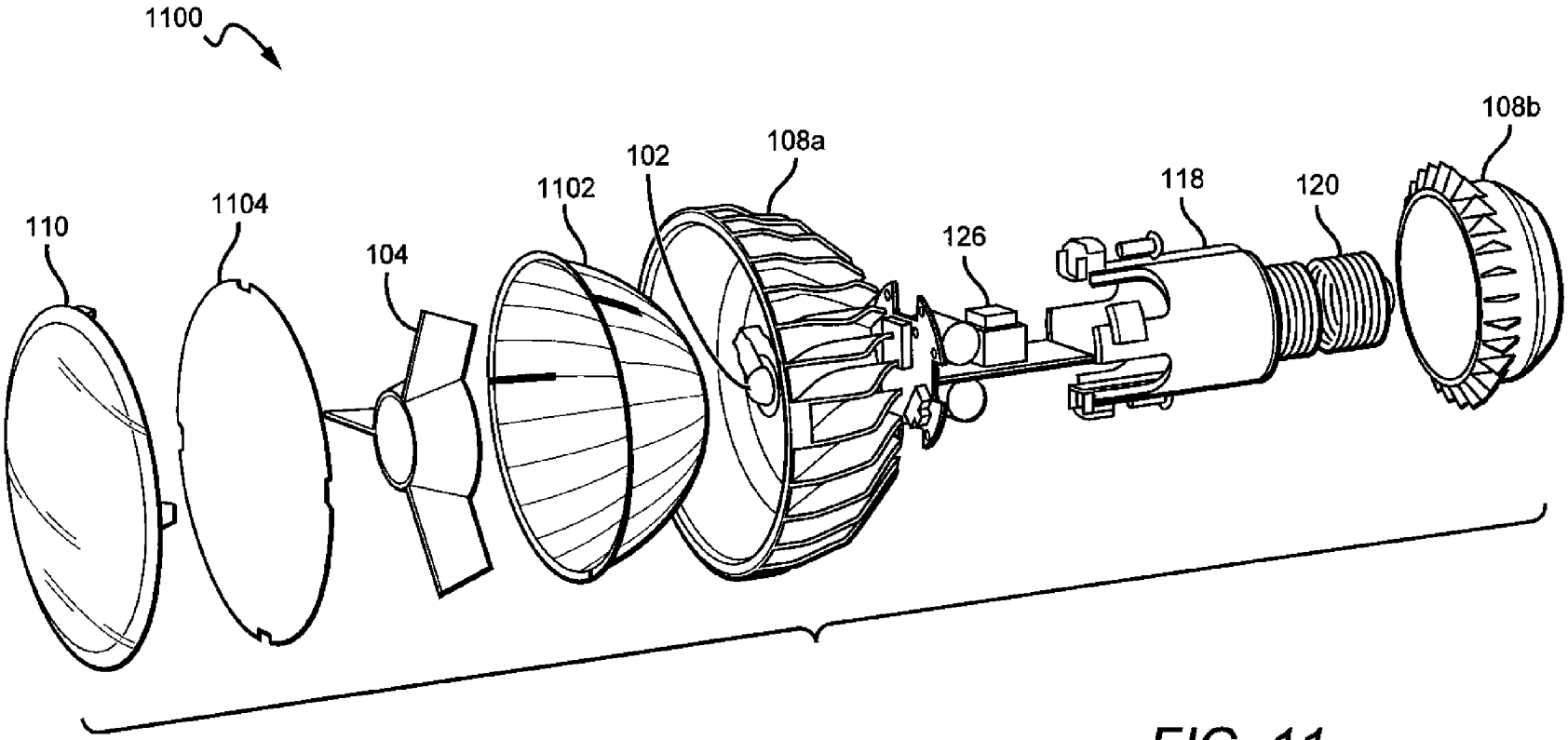
FIG. 11 is an exploded view of a lamp device according to an embodiment of the present invention.

FIG. 11 is an exploded view of a lamp device 1100 according to another embodiment of the present invention. The lamp device 1100 is designed to produce an output beam having a 10 degree beam angle. The intermediate reflector 104 may be similarly shaped, as in this embodiment, or it may have a different shape. The outer reflector 1102 is shaped differently than the outer reflectors 106, 802.

The shape of the outer reflector 1102 is such that the output beam has a 10 degree beam angle. In this embodiment, the outer reflector 1102 comprises adjacent faceted panels similar to the device 100; however, because the lamp device 1100 requires a tighter beam angle than the lamp devices 100, 800, the outer reflector 1102 comprises more panels. The outer reflector 1102 comprises 36 adjacent panels, whereas lamp devices 100, 800 comprise only 24 panels. Generally, the closer the reflector is to a smooth continuous surface around the circumference (e.g., the more panels it has), the tighter the focus of the output beam will be. Other embodiments may comprise more or fewer panels to achieve a particular output beam. The outer reflector 1102 has a compound parabolic cross-section, although other cross-sections are possible.

Because the output beam from the lamp 1100 is narrower than beams from lamp devices 100, 800, the diffuser film 1104 is weaker than those in the lamp devices 100, 800.

Figure 12:
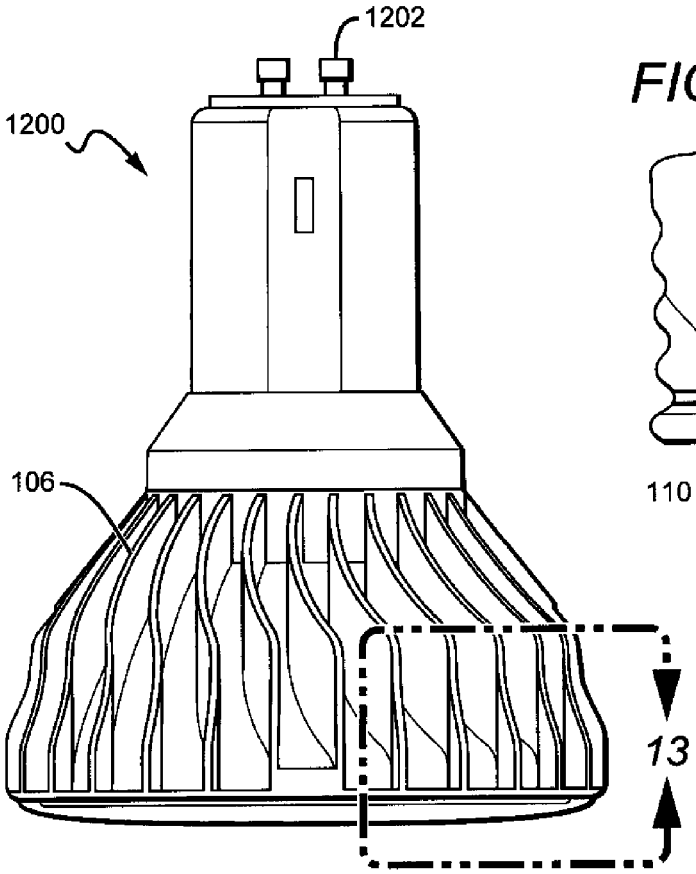
FIG. 12 is a side view of a lamp device according to an embodiment of the present invention.

FIG. 12 is a side view of a lamp device 1200 according to another embodiment of the present invention. In this particular embodiment, the lamp device 1200 is fitted with a GU24 type electrical connection 1202. Many other types of connections are also possible.

Figure 13:
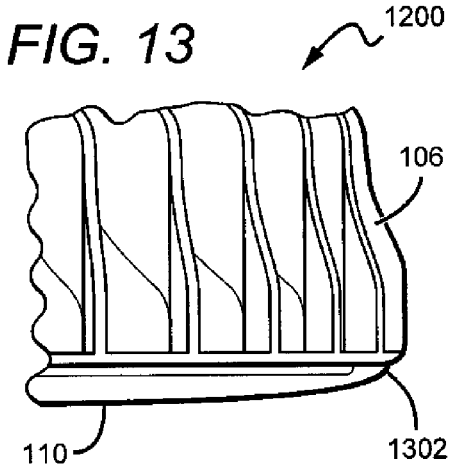
FIG. 13 is a magnified side view of a corner portion of a lamp device according to an embodiment of the present invention.

FIG. 13 is a magnified side view of a corner portion of the outer reflector 106 as shown in FIG. 12. In lamp device this embodiment of the lamp device 1200, the edge 1302 at the top face of the lens 110 remains exposed. This allows some of the light incident on the lens 110 close to the edge 1302 of the outer reflector 106 to leak out as high-angle emission. The high-angle leaked light gives an indication to viewers that the lamp 1200 is powered on, even when viewed at relatively high angles (i.e., off-axis). The exposed edge lens can be used with any of the lamp devices discussed herein and with other embodiments not explicitly discussed.

FIG. 14 is a perspective view of an intermediate reflector 1400 according to an embodiment of the present invention. The intermediate reflector 1400 can be used in any of the lamp devices discussed herein and in other embodiments. The intermediate reflector 1400 comprises side holes that allow some of the light emitted into the intermediate reflector 1400 to escape out the sides. The side holes 1402 can be shaped in many different ways and placed in many different configurations to achieve a particular output profile. For example, the side holes 1402 may be circular, elliptical, rectangular, or any other desired shape.

FIG. 15 shows a perspective view of an intermediate reflector 1500 according to an embodiment of the present invention. The side holes 1502 in this embodiment are rectangular slits. Diffusive elements 1504 are disposed in each of the side holes 1502. For example, the diffusive element may be a diffusive film placed within or over the side holes 1502, or it may be a diffusive coating on the inner walls of the side holes 1502. Thus, the light that escapes through the side holes 1502 is scattered by the diffuser to produce a different effect in the output beam profile.

The embodiments shown in FIGS. 14 and 15 are exemplary. Many other different intermediate reflectors that include side holes and/or slits are possible. As discussed, the side holes may contain diffusive elements or other elements such as wavelength conversion materials, for example.

FIG. 16 is a cross-sectional view of an intermediate reflector 1600 according to an embodiment of the present invention. The intermediate reflector 1600 comprises first and second exterior surfaces 1602, 1604 and an interior surface 1606. A horizontal x-axis and a longitudinal y-axis are shown for reference. The interior surface 1606 is oriented at an angle $\alpha$ with respect to the longitudinal y-axis. In this embodiment, a suitable angular range is $10° \leq \alpha \leq 30°$ with one acceptable value being $\alpha=20°$. The first exterior surface 1602 is disposed at angle $\theta$ from the horizontal x-axis as shown. In this embodiment, a suitable angular range is $20° \leq \theta \leq 50°$ with an acceptable value being $\theta=34°$. The second exterior surface 1604 is oriented at an angle $\beta$ with respect to the longitudinal y-axis. In this embodiment, a suitable angular range is $20° \leq \beta \leq 60°$ with an acceptable value being $\beta=40.3°$. The angles $\alpha$, $\beta$, and $\theta$ may be adjusted to change the profile of the output light beam. It is understood that the ranges and values given herein are exemplary and that other ranges and values for the angles $\alpha$, $\beta$, and $\theta$ may be used in various combinations without departing from the scope of the disclosure.

FIGS. 17*a* and 17*b* show cross-sectional views of an intermediate reflector 1700 according to an embodiment of the present invention. The intermediate reflector 1700 comprises an optical element at the end of the longitudinal hole closest to the light source (not shown). In one embodiment, the optical element comprises a collimating lens 1702 as shown in FIG. 17*a*. The collimating lens 1702 provides added control for light emitted from the source that will be directly emitted through the longitudinal hole. In another embodiment shown in FIG. 17*b*, an element such as Fresnel lens 1704 may be used to achieve a more collimated central beam portion. Other optical elements may also be used.

Although the present invention has been described in detail with reference to certain configurations thereof, other versions are possible. For example, embodiments of a lamp device may include various combinations of primary and secondary reflectors discussed herein. Therefore, the spirit and scope of the invention should not be limited to the versions described above.

I claim:

1. A reflector system, comprising:

a bowl-shaped outer reflector comprising a base end and an open end, said outer reflector configured to at least partially surround a light source; and an intermediate reflector inside said outer reflector said intermediate reflector shaped to define an axial hole, said intermediate reflector comprising at least one leg extending from said intermediate reflector and directly attached to said outer reflector.

2. The reflector system of claim 1, said intermediate reflector comprising a reflective interior surface shaped such that said axial hole is substantially frusto-conical.

3. The reflector system of claim 1, said intermediate reflector along a longitudinal axis running from the center of said base end to the center of said open end such that said axis runs through the center of said axial hole.

4. The reflector system of claim 1, said at least one leg comprising three legs, each of said legs extending from said intermediate reflector to said outer reflector, said legs spaced equidistantly around the exterior of said intermediate reflector.

5. The reflector system of claim 1, further comprising a lens covering said open end of said outer reflector.

6. The reflector system of claim 5, said intermediate reflector attached to said lens.

7. The reflector system of claim 5, said intermediate reflector attachable to said lens with a snap-fit mechanism.

8. The reflector system of claim 5, wherein at least a portion of said lens is roughened.

9. The reflector system of claim 5, wherein an annular section of said lens is roughened, said annular section comprising an inner and an outer radius, said inner radius a distance from the center of said lens.

10. The reflector system of claim 5, further comprising a diffusive film on said lens.

11. The reflector system of claim 5, further comprising a diffusive film on an annular section of said lens, said annular section comprising an inner and an outer radius, said inner radius a distance from the center of said lens.

12. The reflector system of claim 5, wherein at least a portion of an edge of said lens is beyond said outer reflector to allow some of the light incident proximate to said edge to emit at high angles.

13. The reflector system of claim 1, further comprising a housing shaped to surround said outer reflector without obstructing said open end.

14. The reflector system of claim 13, wherein said housing comprises a thermally conductive material, said housing in thermal contact with said outer reflector.

15. The reflector system of claim 1, said outer reflector comprising a faceted surface.

16. The reflector of claim 1, further comprising a collimating optical element disposed within said intermediate reflector at one end of said axial hole.

17. A reflector system, comprising:

a bowl-shaped outer reflector comprising a base end and an open end; and an intermediate reflector inside said outer reflector, wherein said intermediate reflector is shaped to define an axial hole, said intermediate reflector comprising at least first and second exterior surfaces, wherein said first exterior surface is angled to face said base end and said second exterior surface is angled to face said open end.

18. The reflector system of claim 17, said intermediate reflector comprising a reflective interior surface shaped such that said axial hole is substantially frusto-conical.

19. The reflector system of claim 17, further comprising a lens covering said open end of said outer reflector.

20. The reflector system of claim 19, said intermediate reflector attachable to said lens.

21. The reflector system of claim 20, wherein an annular section of said lens is roughened, said annular section comprising an inner and an outer radius, said inner radius a distance from the center of said lens.

22. The reflector system of claim 19, wherein at least a portion of said lens is roughened.

23. The reflector system of claim 17, further comprising at least one light source mounted at said base end and arranged to emit light toward said open end.

24. A lamp device, comprising:

a light source;

an outer reflector comprising a base end and an open end, said light source mounted at said base end and arranged to emit light toward said open end;

an intermediate reflector disposed proximate to said light source, said intermediate reflector shaped to define a hole for at least some light from said light source to pass through said intermediate reflector comprising at least on leg extending from said intermediate reflector and directly attached to said outer reflector;

a housing arranged to surround said outer reflector without obstructing said open end; and a lens arranged to cover said open end.

25. The lamp device of claim 24, said intermediate reflector comprising a reflective interior surface shaped such that said axial hole has a frusto-conical shape.

26. The lamp device of claim 24, said intermediate reflector comprising at least first and second exterior surfaces, said first exterior surface angled to face said base end, said second exterior surface angled to face said open end.

27. The lamp device of claim 24, said intermediate reflector and said light source disposed along a longitudinal axis running from the center of said base end to the center of said open end such that said axis runs through the center of said hole.

28. The lamp device of claim 24, said at least one leg comprising three legs, each of said legs extending from said intermediate reflector to said outer reflector, said legs spaced equidistantly around the exterior of said intermediate reflector.

29. The lamp device of claim 24, said intermediate reflector attached to said lens.

30. The lamp device of claim 24, said intermediate reflector attachable to said lens with a snap-fit mechanism.

31. The lamp device of claim 24, wherein at least a portion of said lens is roughened.

32. The lamp device of claim 24, wherein an annular section of said lens is roughened, said annular section having an inner and an outer radius, said inner radius located a distance from the center of said lens.

33. The lamp device of claim 24, further comprising an encapsulant over said light source.

34. The lamp device of claim 33, said encapsulant comprising a diffusive material.

35. The lamp device of claim 24, said light source comprising multiple light emitting diodes (LEDs).

36. The lamp device of claim 24, said light source comprising blue and red LEDs and an encapsulant covering at least some of said LEDs and having a wavelength conversion material disposed to convert at least a portion of blue light from said blue LEDs to yellow light.

37. The lamp device of claim 24, said housing comprising a thermally conductive material, said housing in thermal contact with said light source.

38. The lamp device of claim 24, said outer reflector comprising a faceted interior surface.

39. The lamp device of claim 24, wherein said lamp device produces a light beam having a beam angle of approximately 25 degrees.

40. The lamp device of claim 24, wherein said lamp device produces a light beam having a beam angle of approximately 50 degrees.

41. The lamp device of claim 24, wherein said lamp device produces a light beam having a beam angle of approximately 10 degrees.

42. The lamp device of claim 24, further comprising a diffusive film disposed on said lens.

43. The lamp device of claim 42, further comprising an encapsulant over said light source, said encapsulant comprising a diffusive material.

44. The lamp device of claim 42, wherein said diffusive film is disposed on a surface of said lens that faces said light source.

45. The lamp device of claim 42, wherein said lamp device produces a light beam having a beam angle that is associated with the strength of said diffusive film, such that said beam angle is adjustable by replacing said diffusive film with a different diffusive film.

46. The lamp device of claim 24, further comprising a diffusive film disposed on an annular section of said lens, said annular section having an inner and an outer radius, said inner radius located a distance from the center of said lens.

47. The lamp device of claim 24, wherein said light source comprises at least one light emitting diode (LED).

48. The lamp device of claim 24, wherein at least a portion of an edge of said lens is exposed beyond said housing to allow some of the light incident proximate to said edge to emit at high angles.

49. The lamp device of claim 24, further comprising a collimating optical element disposed within said axial hole at the end of said intermediate reflector closest to said light source.

50. A reflector system, comprising:

an outer reflector comprising a base end and an open end; and an intermediate reflector at least partially inside and in a fixed relationship with said outer reflector, said intermediate reflector comprising a first end and a second end said intermediate reflector comprising at least first and second exterior surfaces, wherein said first exterior surface is angled to face said base end and said second exterior surface is angled to face said open end.

51. The reflector system of claim 50, wherein said intermediate reflector comprises a substantially frustoconical first portion and a substantially frustoconical second portion integral with said first portion;

wherein a largest diameter of said first portion is equal to the largest diameter of said second portion.

52. The reflector system of claim 51, wherein the largest diameter of said first portion and the largest diameter of said second portion are at a junction between said first and second portions.

53. The reflector system of claim 50, wherein said intermediate reflector is shaped to define an axial hole.

54. The reflector system of claim 53, wherein said axial hole is substantially frustoconical from said first end to said second end.

55. The reflector system of claim 50, wherein said intermediate reflector comprises first and second portions;

wherein the largest width of said first portion is equal to the largest width of said second portion.

56. The reflector system of claim 50, further comprising one or more legs connecting said intermediate reflector to said outer reflector.

57. The reflector system of claim 56, wherein said intermediate reflector comprises first and second portions;

wherein said one or more legs are connected to only one of said first and second portions.

58. The reflector system of claim 57, wherein said legs are connected to the one of said first and second portions nearer said open end.

59. The reflector system of claim 57, wherein said intermediate reflector comprises first and second portions;

wherein said one or more legs are connected to said intermediate reflector at a junction between said first and second portions.

60. The reflector system of claim 50, wherein said outer reflector is bowl-shaped or substantially frustoconical.

* * * * *